US007631962B2

(12) United States Patent
Bibl et al.

(10) Patent No.: US 7,631,962 B2
(45) Date of Patent: Dec. 15, 2009

(54) SINGLE-USE DROPLET EJECTION MODULE

(75) Inventors: Andreas Bibl, Los Altos, CA (US); John A. Higginson, Santa Clara, CA (US); Kevin Von Essen, San Jose, CA (US); Antai Xu, Cupertino, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 411 days.

(21) Appl. No.: 11/305,824

(22) Filed: Dec. 16, 2005

(65) Prior Publication Data

US 2006/0158489 A1 Jul. 20, 2006

Related U.S. Application Data

(60) Provisional application No. 60/637,254, filed on Dec. 17, 2004, provisional application No. 60/699,134, filed on Jul. 13, 2005.

(51) Int. Cl.
*B41J 2/175* (2006.01)
*B41J 2/05* (2006.01)
*B41J 2/14* (2006.01)

(52) U.S. Cl. ..... 347/87; 347/66; 347/49

(58) Field of Classification Search ..... 347/84, 347/86, 85, 87, 49, 66
See application file for complete search history.

(56) References Cited

U.S. PATENT DOCUMENTS 5,606,352 A 2/1997 Yamakawa et al.
5,721,576 A * 2/1998 Barinaga ..... 347/85
5,732,751 A * 3/1998 Schmidt et al. ..... 141/48
5,777,646 A * 7/1998 Barinaga et al. ..... 347/86
5,781,213 A 7/1998 Ujita et al.
5,796,419 A * 8/1998 Clark et al. ..... 347/85
5,880,764 A * 3/1999 Barinaga ..... 347/86

(Continued)

FOREIGN PATENT DOCUMENTS

EP 1101615 5/2001

(Continued)

OTHER PUBLICATIONS

International Search Report and Written Opinion of the International Searching Authority, PCT Application Serial No. PCT/US2005/045919, May 19, 2006, 14 pp.

(Continued)

*Primary Examiner*—Stephen D Meier
*Assistant Examiner*—Rene Garcia, Jr.
(74) *Attorney, Agent, or Firm*—Fish & Richardson P.C.

(57) ABSTRACT

A printhead assembly including one or more nozzles is described that can include a droplet ejection module. In one embodiment, the droplet ejection module includes a liquid supply assembly, a housing and a droplet ejection body. The liquid supply assembly includes a self-contained liquid reservoir and a liquid outlet. The housing is configured to permanently connect to the liquid supply assembly and includes a liquid channel configured to receive a liquid from the liquid outlet of the liquid supply assembly and to deliver the liquid to a droplet ejection body. The droplet ejection body is permanently connected to the housing and includes one or more liquid inlets configured to receive liquid from the housing and one or more nozzles configured to selectively eject droplets.

22 Claims, 23 Drawing Sheets

U.S. PATENT DOCUMENTS

| | | | | |
|---|---|---|---|---|
| 5,900,896 | A * | 5/1999 | Barinaga et al. | 347/86 |
| 6,183,077 | B1 * | 2/2001 | Hmelar et al. | 347/86 |
| 6,322,207 | B1 * | 11/2001 | Hall et al. | 347/85 |
| 6,341,842 | B1 | 1/2002 | Beach et al. | |
| 6,378,997 | B1 | 4/2002 | Nitta | |
| 6,428,142 | B1 | 8/2002 | Silverbrook | |
| 6,502,930 | B1 | 1/2003 | Shimada et al. | |
| 6,796,646 | B2 * | 9/2004 | Komplin et al. | 347/86 |
| 6,848,773 | B1 * | 2/2005 | Hoisington et al. | 347/68 |
| 6,910,759 | B2 * | 6/2005 | Kawamura et al. | 347/50 |
| 6,921,161 | B2 * | 7/2005 | Morita et al. | 347/86 |
| 7,070,267 | B2 * | 7/2006 | Yamaguchi et al. | 347/93 |
| 7,114,801 | B2 * | 10/2006 | Hall et al. | 347/92 |
| 7,147,310 | B2 * | 12/2006 | Steinmetz et al. | 347/86 |
| 7,185,976 | B2 * | 3/2007 | Inoue et al. | 347/86 |
| 7,188,937 | B2 * | 3/2007 | Wilson et al. | 347/85 |
| 7,278,708 | B2 * | 10/2007 | Shinada et al. | 347/50 |
| 7,284,843 | B2 * | 10/2007 | Silverbrook | 347/85 |
| 7,300,142 | B1 * | 11/2007 | Usui et al. | 347/86 |
| 7,328,985 | B2 * | 2/2008 | Silverbrook | 347/86 |
| 2004/0183873 | A1 * | 9/2004 | Steinmetz et al. | 347/86 |
| 2005/0093922 | A1 | 5/2005 | McGarry et al. | |
| 2006/0158486 | A1 | 7/2006 | Bibl et al. | |

FOREIGN PATENT DOCUMENTS

| | | |
|---|---|---|
| JP | 2000-158645 | 6/2000 |
| JP | 2001-301179 | 10/2001 |
| WO | 03/013863 | 2/2003 |

OTHER PUBLICATIONS

Examination Report (translation) dated Feb. 27, 2009 from Chinese Application No. 200580048178.2, 11 pages.

European Patent Examiner Maude Bardet, Examination Report dated Oct. 8, 2009 from European Application No. 05 854 598.9, 4 pages.

* cited by examiner

SINGLE-USE DROPLET EJECTION MODULE

CROSS REFERENCE TO RELATED APPLICATIONS

This application claims priority to pending U.S. Provisional Application Ser. No. 60/637,254, entitled "Single-Use Droplet Ejection Module", filed on Dec. 17, 2004, the entire contents of which are hereby incorporated by reference, and claims priority to pending U.S. Provisional Application Ser. No. 60/699,134, entitled "Single-Use Droplet Ejection Module", filed on Jul. 13, 2005, the entire contents of which are hereby incorporated by reference. This application is related to concurrently filed U.S. Application entitled "Printhead Module", filed on Dec. 16, 2005, and assigned U.S. Ser. No. 11/303,743 , by Andreas Bibl and Melvin L. Biggs.

BACKGROUND

The following description relates to a printhead assembly including one or more nozzles.

An ink jet printer typically includes an ink path from an ink supply to an ink nozzle assembly that includes nozzles from which ink drops are ejected. Ink drop ejection can be controlled by pressurizing ink in the ink path with an actuator, which may be, for example, a piezoelectric deflector, a thermal bubble jet generator, or an electrostatically deflected element. A typical printhead has a line of nozzles with a corresponding array of ink paths and associated actuators, and drop ejection from each nozzle can be independently controlled. In a so-called "drop-on-demand" printhead, each actuator is fired to selectively eject a drop at a specific pixel location of an image, as the printhead and a printing media azre moved relative to one another. In high performance printheads, the nozzles typically have a diameter of 50 microns or less (e.g., 25 microns), are separated at a pitch of 100-300 nozzles per inch and provide drop sizes of approximately 1 to 70 picoliters (pl) or less. Drop ejection frequency is typically 10 kHz or more.

A printhead can include a semiconductor printhead body and a piezoelectric actuator, for example, the printhead described in Hoisington et al., U.S. Pat. No. 5,265,315. The printhead body can be made of silicon, which is etched to define ink chambers. Nozzles can be defined by a separate nozzle plate that is attached to the silicon body. The piezoelectric actuator can have a layer of piezoelectric material that changes geometry, or bends, in response to an applied voltage. The bending of the piezoelectric layer pressurizes ink in a pumping chamber located along the ink path.

Printing accuracy can be influenced by a number of factors, including the uniformity in size and velocity of ink drops ejected by the nozzles in the printhead and among the multiple printheads in a printer. The drop size and drop velocity uniformity are in turn influenced by factors, such as the dimensional uniformity of the ink paths, acoustic interference effects, contamination in the ink flow paths, and the uniformity of the pressure pulse generated by the actuators. Contamination or debris in the ink flow can be reduced with the use of one or more filters in the ink flow path.

SUMMARY

A printhead assembly including one or more nozzles is described. In general, in one aspect, the invention features a droplet ejection module. The droplet ejection module includes a liquid supply assembly, a housing and a droplet ejection body. The liquid supply assembly includes a self-contained liquid reservoir and a liquid outlet. The housing is configured to permanently connect to the liquid supply assembly and includes a liquid channel configured to receive a liquid from the liquid outlet of the liquid supply assembly and to deliver the liquid to a droplet ejection body. The droplet ejection body is permanently connected to the housing and includes one or more liquid inlets configured to receive liquid from the housing and one or more nozzles configured to selectively eject droplets.

Implementations of the invention can include one or more of the following features. The liquid supply assembly can further include a seal operable to prevent the liquid from exiting the liquid reservoir through the liquid outlet. The housing can be connected to the liquid supply assembly in a first position, where the seal prevents the liquid from exiting the liquid outlet and entering the liquid channel, and can be connected to the liquid supply assembly in a second position, where the seal does not prevent the liquid from exiting the liquid outlet and entering the liquid channel. The housing can be configured to connect to the liquid supply assembly in the first and second positions by a snap-fit connection.

The liquid supply assembly can further include a liquid supply housing, and a vacuum chamber can be formed within the liquid supply housing including a port for providing vacuum to the vacuum chamber. The liquid reservoir can be a flexible container adapted to contain a liquid, where the flexible container is positioned within the vacuum chamber in the liquid supply housing.

In general, in another aspect, the invention features a droplet ejection module including a housing, a droplet ejection body mounted to the housing, a flexible circuit, and a liquid supply assembly. The droplet ejection body has a nozzle face including at least one nozzle for ejecting a liquid and a back face having at least one liquid channel. The flexible circuit is attached to the housing and to the nozzle face of the droplet ejection body. The flexible circuit is electrically connected to the droplet ejection body to provide drive signals controlling liquid ejection from the at least one nozzle. The flexible circuit can be connected, directly or indirectly, to a processor or integrated circuit from which the drive signals originate. The liquid supply assembly is attached to the housing and in fluid communication with the back face of the droplet ejection body. The liquid supply assembly includes a self-contained liquid reservoir and an outlet providing a liquid path from the liquid supply assembly to the liquid channel formed in the back face of the printhead body.

Implementations can include one or more of the following. The droplet ejection module can further include one or more pumping chambers formed in a base substrate, where each pumping chamber includes a receiving end configured to receive a liquid from a liquid supply and an ejecting end for ejecting the liquid from the pumping chamber. A nozzle plate can be attached to the base substrate including one or more nozzles formed through the nozzle plate, where a nozzle is in fluid communication with each pumping chamber and receives liquid from the ejecting end of the pumping chamber for ejection from the nozzle. One or more piezoelectric actuators can be connected to the nozzle plate, where a piezoelectric actuator is positioned over each pumping chamber and includes a piezoelectric material configured to deflect and pressurize the pumping chamber, so as to eject liquid from a corresponding nozzle that is in fluid communication with the ejecting end of the pumping chamber.

The liquid supply assembly can include a liquid supply housing, a vacuum chamber formed within the liquid supply housing including a port for providing vacuum to the vacuum chamber, and a bag adapted to contain a liquid, the bag positioned within the vacuum chamber in the liquid supply housing.

The invention can be implemented to realize one or more of the following advantages. A printhead module that can be effectively used with a relatively small number of nozzles is provided that is ideal for uses involving small volumes of printing liquid. The self-contained printing liquid reservoir can be easily filled with a small volume of printing liquid, attached to a printhead housing and used for a printing operation. One implementation in which small printing liquid volumes is desirable is printing liquid test operations. The self-contained printing liquid reservoir can be filled with a test printing liquid and attached to the printhead housing to conduct a test operation. The entire assembly can be disposed of following the testing operation, avoiding having to flush clean a printhead module between tests. A one snap connection can be made to mount the printhead module into a mounting assembly, whereby an electrical connection and connection to a vacuum source are made simultaneously.

Details of one or more implementations are set forth in the accompanying drawings and the description below. Other features and advantages may be apparent from the description and drawings, and from the claims.

DRAWING DESCRIPTIONS

These and other aspects will now be described in detail with reference to the following drawings.

FIGS. 1A-E show a droplet ejection module including a self contained liquid supply assembly.

FIGS. 1F-H show enlarged views of a portion of a sealing mechanism included in the droplet ejection module of FIGS. 1C and D.

FIGS. 2A-D show another embodiment of a droplet ejection module including a self contained liquid supply assembly.

FIGS. 3A-B show a droplet ejection body including 10 nozzles.

FIGS. 4A-B show an alternative droplet ejection body including 10 nozzles.

FIGS. 5A-C show a flexible circuit attached to a droplet ejection body and to a housing.

FIGS. 7A-E show an alternative embodiment of a droplet ejection module including a self contained liquid supply assembly.

Like reference symbols in the various drawings indicate like elements.

DETAILED DESCRIPTION

A droplet ejection module is described that includes pressurized pumping chambers to selectively eject a liquid from nozzles. A typical liquid is ink, and for illustrative purposes, the droplet ejection module is described below in reference to a printhead module that uses ink as the printing liquid. However, it should be understood that other liquids can be used, for example, electroluminescent material used in the manufacture of liquid crystal displays or liquid metals used in circuit board fabrication.

A printhead module generally includes a printhead body with multiple nozzles that are in fluid communication with an external ink supply to allow for a continuous printing operation. In certain applications, a printhead module that can be effectively operated using a relatively small volume of ink, e.g., for an ink testing operation, is desirable. A printhead module configured to house a printhead body with a relatively small number of nozzles, e.g., from one to ten nozzles, is suitable for such an operation, and includes an ink supply assembly designed for a relatively small volume of printing liquid. In one embodiment, a non-refillable ink supply assembly can be attachable to a printhead body, e.g., a single-use printing liquid supply cartridge, thereby avoiding having to flush clean an ink supply assembly when testing different printing liquids.

Figure 1A:
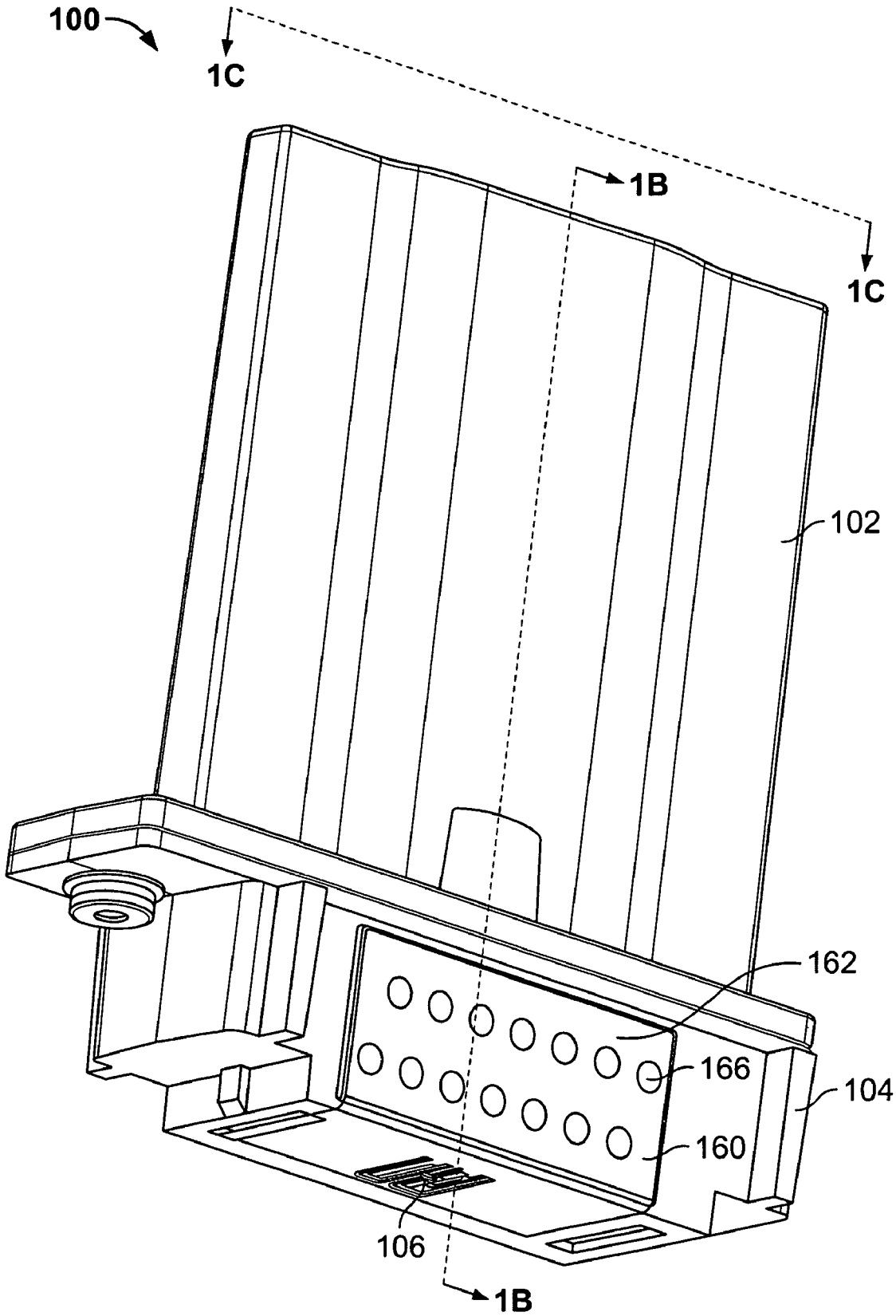

FIG. 1A shows a printhead module 100 that includes an ink supply assembly 102 that is attached to a printhead housing 104. A printhead body 106 can be connected to the printhead housing 104. The ink supply assembly 102 includes a self contained ink reservoir configured to hold a small volume of ink, for example, for testing.

Figure 1B:
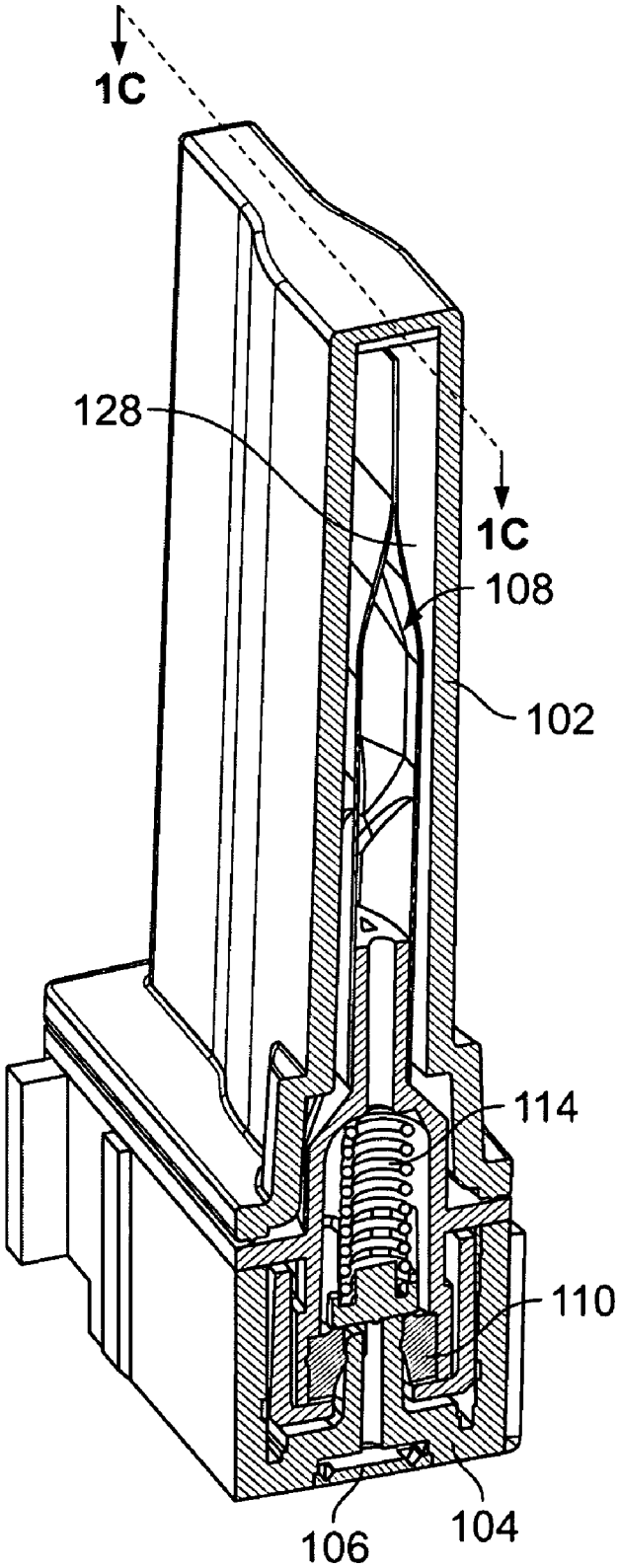
Figure 1C:
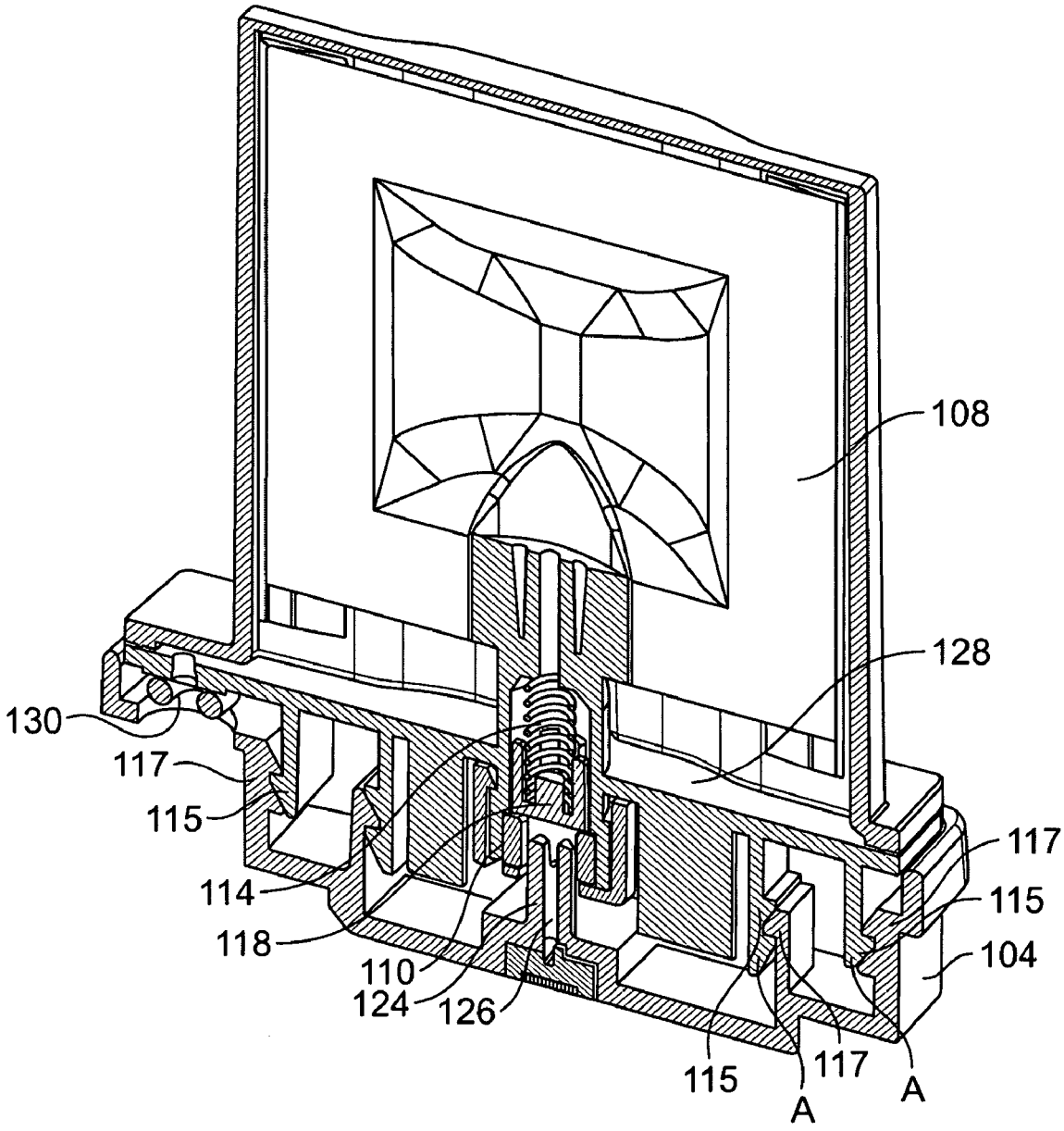
Figure 1D:
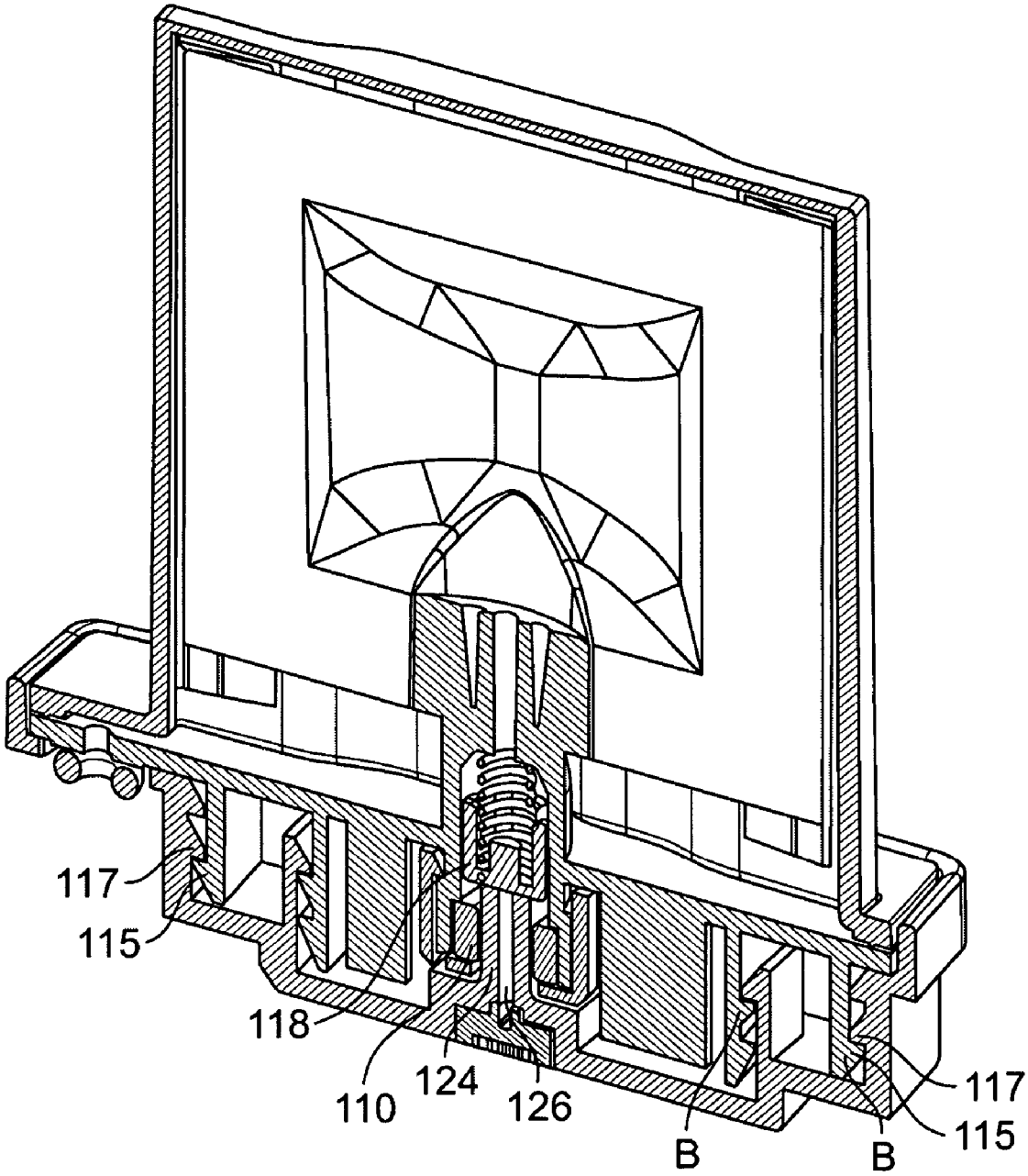
Figure 1E:
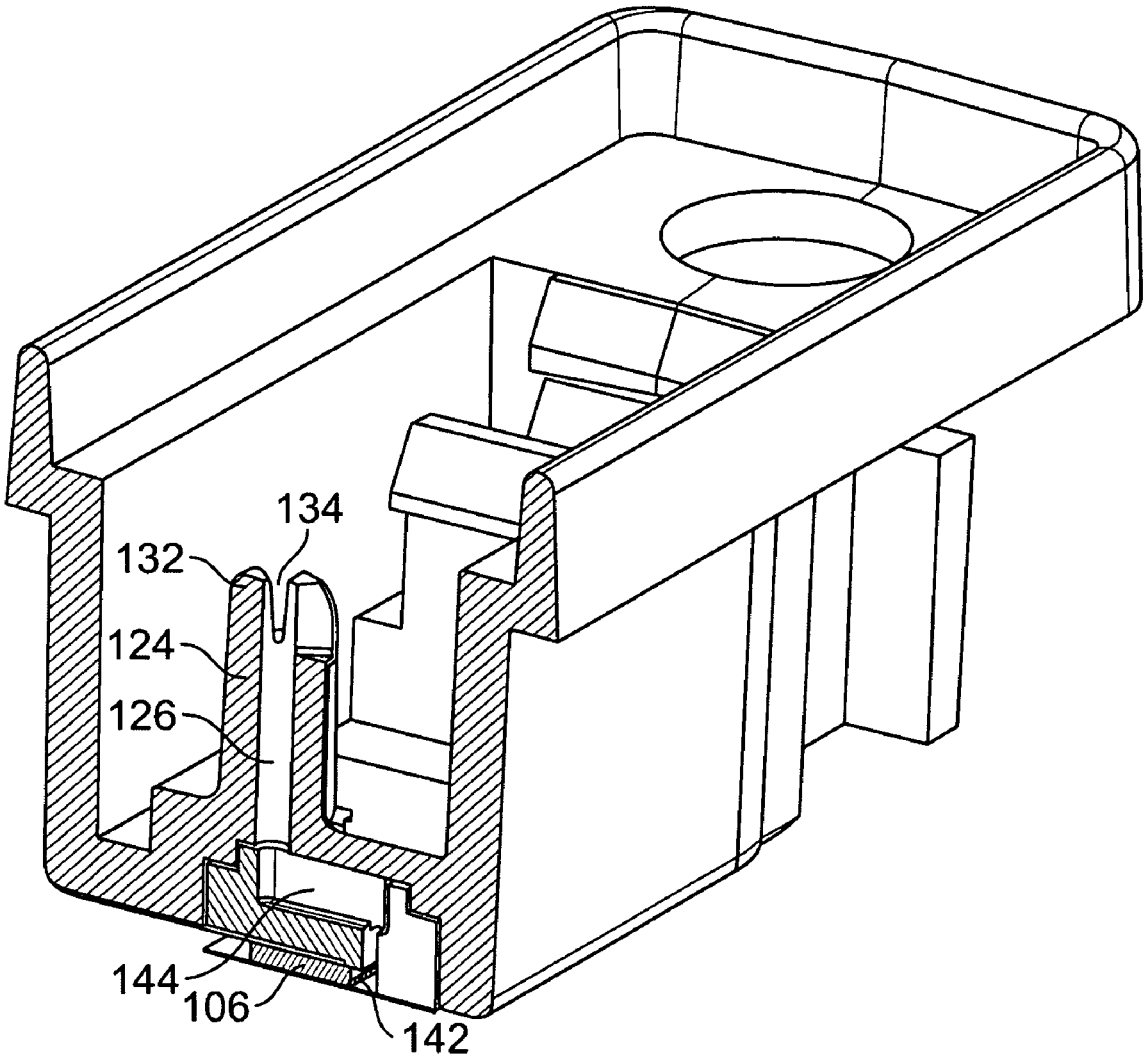

FIG. 1B is a cross-sectional perspective view of the printhead module 100 depicted in FIG. 1A taken along line 1B-1B. FIG. 1C is a cross-sectional perspective view of the printhead module 100, taken along line 1C-1C, showing the printhead module 100 in a closed position. FIG. 1D is the same cross-sectional perspective view of the printhead module 100, but shows the printhead module 100 in an open position. FIG. 1E is an enlarged, cross-sectional view of a portion of the printhead housing 104, including the printhead body 106.

Referring particularly to FIG. 1B, the ink supply assembly 102 includes a self-contained reservoir 108 for containing the small volume of ink. In the embodiment depicted, the self-contained reservoir 108 is a flexible container, similar to a bag, and shall be referred to as an ink bag, although other forms of self-contained reservoirs can be used. A self-contained reservoir can be a reservoir that is filled with ink and sealed, the ink remaining in the reservoir until used. There is no external source of ink attached to the reservoir to provide a continuous source of ink; rather the ink to be used is the ink contained within the self-contained reservoir. The ink bag 108 can be filled with the ink before the ink supply assembly 102 is attached to the printhead housing 104. A seal 110, e.g., an O-ring, creates a seal between the ink supply assembly 102 and the printhead housing 104.

Referring particularly to FIGS. 1C and 1D, the embodiment depicted includes a double snap-fit connection, whereby the ink supply assembly 102 can be first attached to the printhead housing 104 in position A, the closed position (FIG. 1C). In the closed position, the ink bag 108 is not in fluid communication with the printhead body 106. Prior to commencing a printing operation, the ink supply assembly 102 is moved into position B, the open position (FIG. 1D). In the open position, the ink bag 108 is in fluid communication with the printhead body 106 via an ink inlet 124 formed in the printhead housing 104.

To connect the ink supply assembly 102 to the printhead housing 104 in the closed position A, a user aligns the male connectors 115 protruding from the ink supply assembly 102 with the corresponding female connectors 117 formed in the printhead housing 104 and exerts enough force to engage the male connectors 115 with the female connectors 117 at position A, but not too much force so as to engage the female connectors 117 at position B. The user should receive enough tactile feedback when mating the ink supply assembly 102 to the printhead housing 104 to determine when position A has been reached.

To move the ink supply assembly 102 into the open position B with respect to the printhead housing 104, a user exerts additional force to engage the male connectors 115 with the female connectors 117 at position B. The male connectors 115 have enough flexibility to bend under pressure to disengage from the female connectors 117 at position A and snap into engagement at position B. The female connectors 117 can be configured to facilitate this movement, for example, by having angled faces as depicted that encourage the similarly angled male connectors 115 to slide out of engagement upon the exertion from a downward force. The above describes one implementation of a double snap-fit connection. Other configurations of a double snap-fit connection can be used, as well as other types of connections that allow for a closed and an open position.

The fluid path formed between the ink supply assembly 102 and the printhead body 106 can be better understood by further explaining the configuration of the ink inlet 124, shown in closer detail in FIG. 1E. At the distal end of the ink inlet 124 are fingers 132 separated by grooves 134. When ink is present at the distal end of the ink inlet 124, the ink flows through the grooves 134 and into an ink channel 126 formed in the center of the ink inlet 124.

Figure 1F:
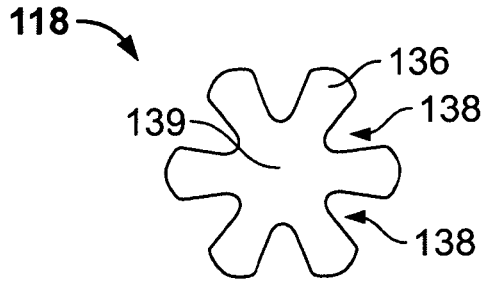
Figure 1G:
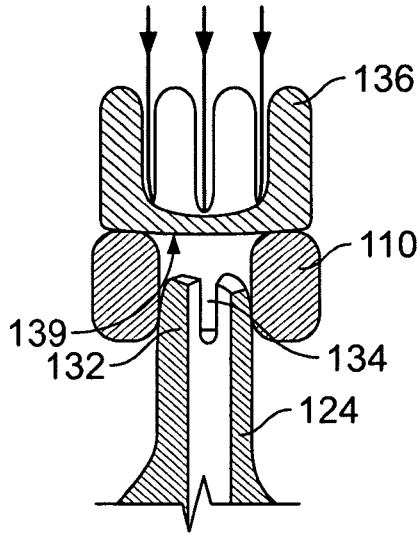
Figure 1H:
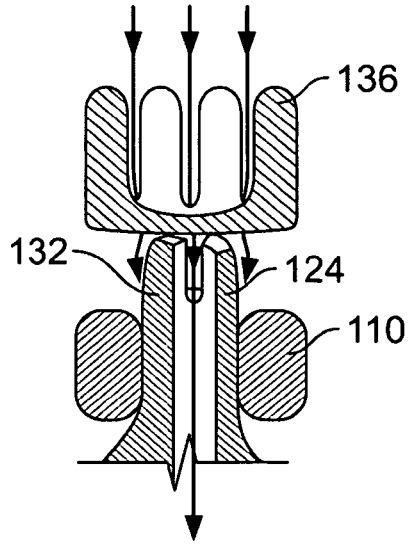

Referring to FIGS. 1C, 1D and 1F-H, the ink supply assembly 102 includes an outlet head 118 also having fingers 136 radiating from a central hub 139 and separated by flow paths 138. FIG. 1F shows a bottom view of the outlet head 118; the flow paths 138 provide a fluid path from the ink bag 108. FIG. 1G shows the outlet head 118, seal 110 and ink inlet 124 when the printhead module is in a closed position as shown in FIG. 1C. In this position, the seal is in contact with the bottom surface of the outlet head 118 and blocks the flow paths 138; ink cannot flow past the fingers 136. A spring 114 in the outlet head 118 exerts a downward force compressing the seal 110. FIG. 1H shows the outlet head 118, seal 100 and ink inlet 124 when the printhead module is in an open position as shown in FIG. 1D. In this position, the bottom of the outlet head 118 contacts the ink inlet 124, which can compress the spring 114 (FIG. 1D) within the outlet head 118. The seal 110 is positioned past the distal end of the ink inlet 124 and is not in contact with the bottom of the outlet head 118; the flow paths 138 are no longer blocked by the seal 110. Ink can thereby flow from the ink bag 108 through the flow paths 138 formed between the fingers 136 of the outlet head 118 and into the ink channel 126 formed in the ink inlet 124 through the grooves 134 formed therein.

FIG. 1E shows one embodiment of a printhead body 106 having openings 142 along a side to receive ink. The fluid path through the ink channel 126 into a chamber 144 that fluidly connects to the openings 142 permits ink to flow from the ink bag 108 into the printhead body 106 for ejection from nozzles included therein.

The ink supply assembly 102 includes a vacuum chamber 128 housing the ink bag 108. A vacuum is maintained in the vacuum chamber 128 by a valve 130 that can be connected to a vacuum source. Maintaining a vacuum in the vacuum chamber 128 applies a negative pressure to the ink bag 108, relative to atmospheric pressure outside the nozzles, that can create a pressure at the meniscus at the nozzles openings, so that the ink does not leak from the nozzles. At the same time, the pressure at the meniscus is such that air is not drawn back into the pumping chamber.

In one embodiment, attaching the ink supply assembly 102 to the printhead housing 104 can be permanent and once the ink contained within the ink bag 108 has been used, the printhead module 100 can be discarded. The ink bag 108 is filled via the outlet head 118 before attaching the ink supply assembly 102 to the printhead housing 104. The printhead module 100 thereby provides a self-contained disposable testing unit that uses only a small volume of test liquid. Because the printhead module 100 is only used once, testing can occur without flushing clean printhead modules between tests.

Figure 2A:
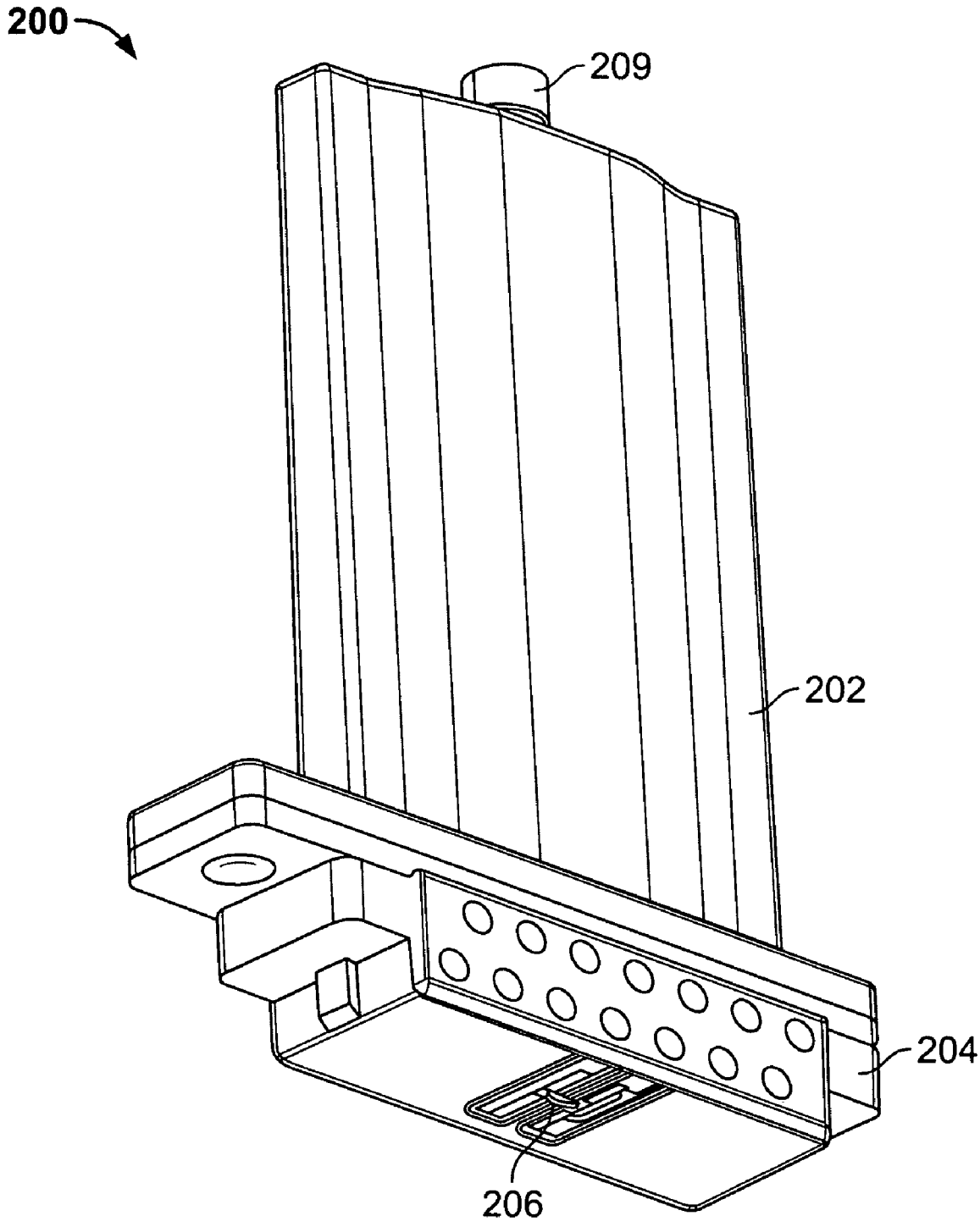

Referring to FIGS. 2A-D, a second embodiment of a printhead module 200 that can be used with a printhead body having a relatively small number of nozzles is shown. Referring particularly to FIG. 2A, the printhead module 200 includes an ink supply assembly 202 that is attached to a printhead housing 204. A printhead body 206 is connected to the printhead housing 204.

Figure 2B:
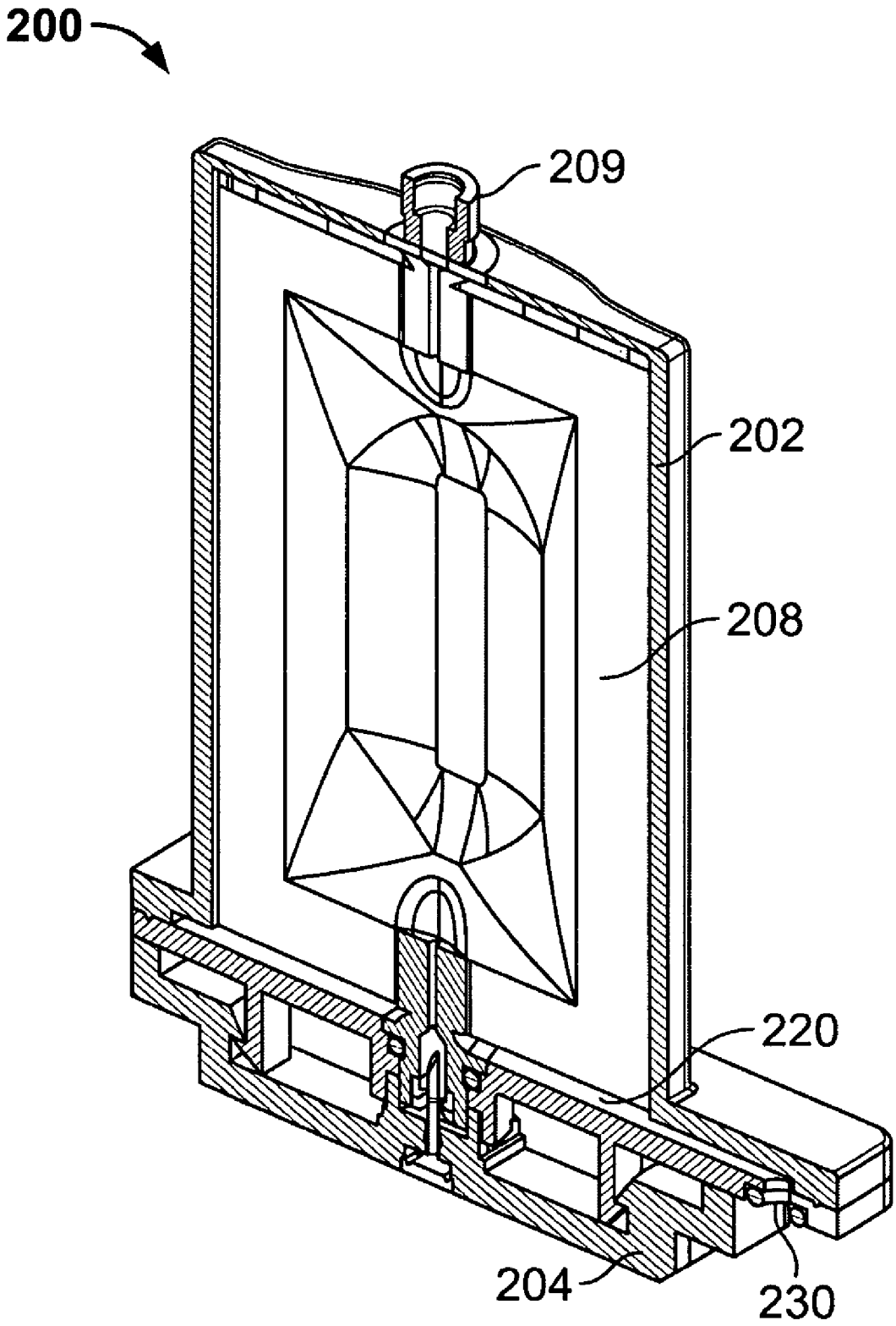
Figure 2C:
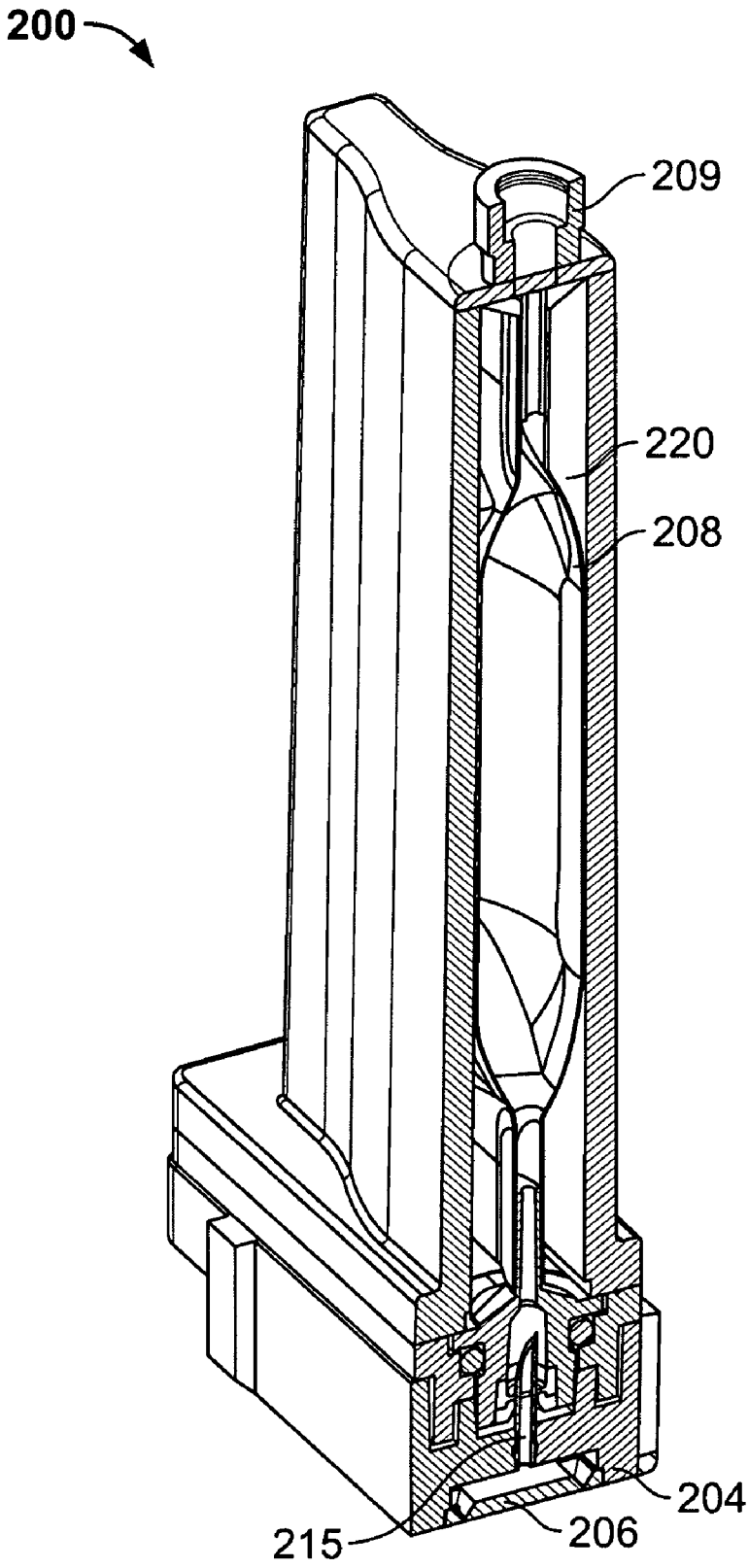

FIG. 2B is a cross-sectional perspective view of the printhead module 200 depicted in FIG. 2A taken along line 2B-2B. FIG. 2C is a cross-sectional perspective view of the printhead module 200 taken along line 2C-2C. The ink supply assembly 202 includes a self-contained reservoir 208 for containing the small volume of ink. In the embodiment depicted, the self-contained reservoir 208 is a flexible container, similar to a bag, and shall be referred to as an ink bag, although other forms of self-contained reservoirs can be used. The ink bag 208 can be filled with the ink before or after the ink supply assembly 202 is attached to the printhead housing 204. Ink is injected into the ink bag 208 through a port 209 at the top of the ink bag 208. In one embodiment, the port 209 can be sealed with a self-sealing material, that can be pierced by a needle and a syringe can be used to inject ink into the ink bag 108. One example of a self-sealing material is a moldable elastomer, such as ALCRYN available from Advanced Polymer Alloys of Wilmington, Del. Once the ink bag 208 is full, the needle is withdrawn and the material self-seals, thereby resealing the port 209.

Figure 2D:
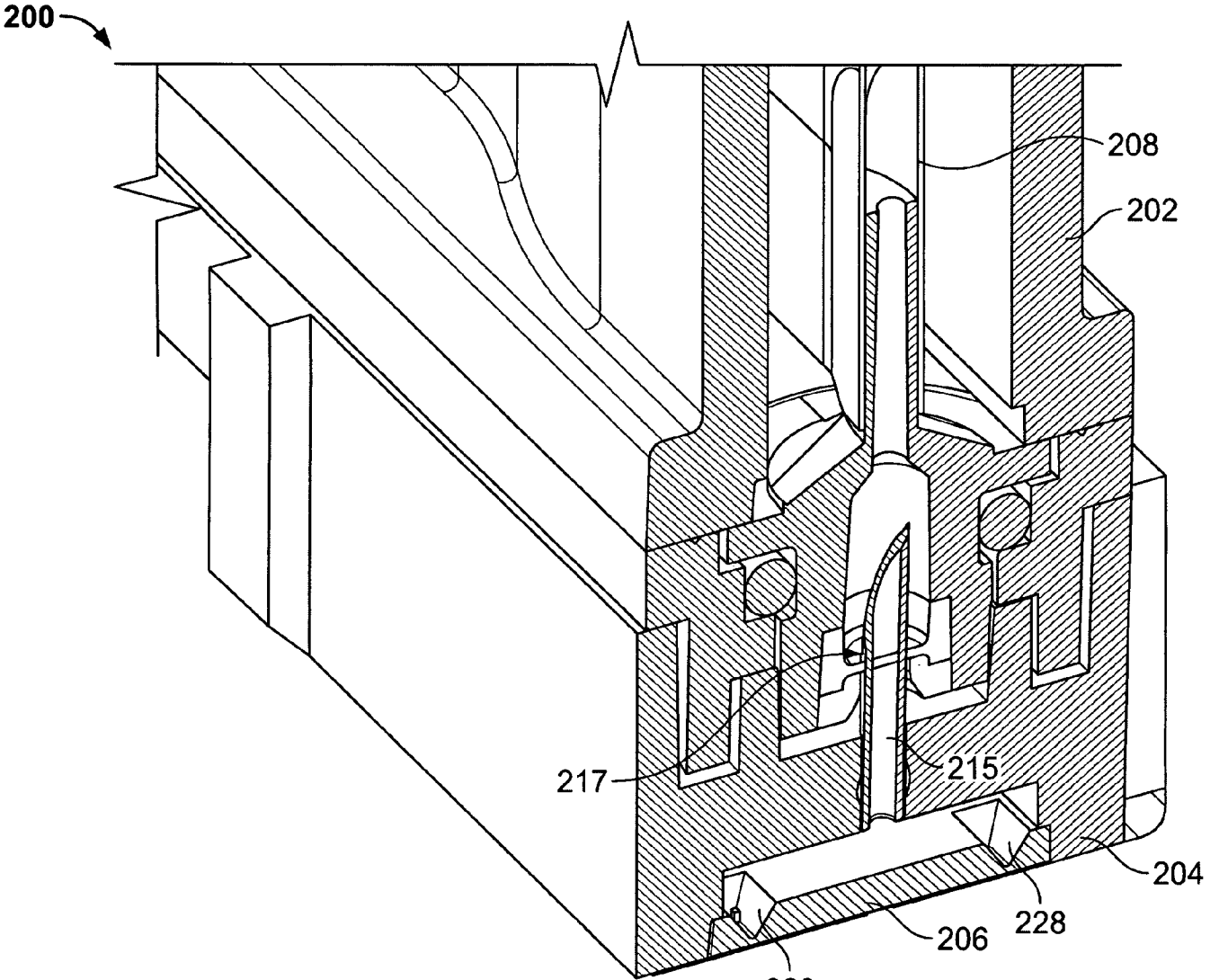

Preferably the ink bag 208 is filled before the ink supply assembly 202 is attached to the printhead housing 204. Referring particularly to FIG. 2D, when the ink supply assembly 202 is attached to the printhead housing 204, an ink inlet 215 included in the printhead housing 204 punctures a septum 217 sealing the bottom of the ink bag 208, thereby allowing ink to flow from the ink bag 208 toward the printhead body 206. In the embodiment shown, the printhead body 206 includes ink channels 228 formed on the back face to receive ink that is then directed toward the nozzles formed on the opposite face of the printhead body 206.

Referring particularly to FIG. 2B, the ink supply assembly 202 can connect to the printhead housing 204 by a snap fit connection 218. Optionally, a double snap-fit connection (not shown) can be used, similar to as described above in reference to FIGS. 1A-E. That is, a first snap can attach the ink supply assembly 202 to the printhead housing 204 without puncturing the septum 217, i.e., the closed position. A second snap can push the ink inlet 215 through the septum 217 creating a flow path from the ink bag 208 to the printhead body 206, i.e., the open position.

The ink supply assembly 202 includes a vacuum chamber 220 housing the ink bag 208. A vacuum is maintained in the vacuum chamber 220 by a valve 230 that can be attached to a vacuum source. Maintaining a vacuum in the vacuum chamber 220 applies a negative pressure to the ink bag 208, relative to the atmospheric outside the nozzles, that can create a pressure at the meniscus at the nozzle openings so that the ink does not leak from the nozzles. At the same time, the pressure at the meniscus is such that air is not drawn back into the pumping chamber.

As described above in reference to the embodiment depicted in FIGS. 1A-H, attaching the ink supply assembly 202 to the printhead housing 204 can be permanent and once the ink contained within the ink bag 208 has been used, the printhead module 200 can be discarded. The printhead module 200 thereby provides a self-contained disposable unit that uses only a small volume of liquid, e.g., a test liquid. Because the printhead module 200 is only used once, testing can occur without flushing clean printhead modules between tests. Alternatively, the ink bag 208 can be refilled via the port 209 for subsequent printing operations, however, because the ink bag 208 cannot easily be cleaned, this is not recommended unless refilling with the same ink.

In an alternative embodiment, the port 209 can be eliminated. The septum 217 can be formed from a self-sealing material and ink can be injected into the ink bag 208 via the septum 217 before the ink supply assembly 202 is attached to the printhead housing 204. Alternatively, ink can be injected into the ink bag 208 before the septum 217 is attached; once the ink bag 208 is filled the septum 217 can be attached to seal the ink bag 208, which can then be attached to the printhead housing 204.

Figure 3A:
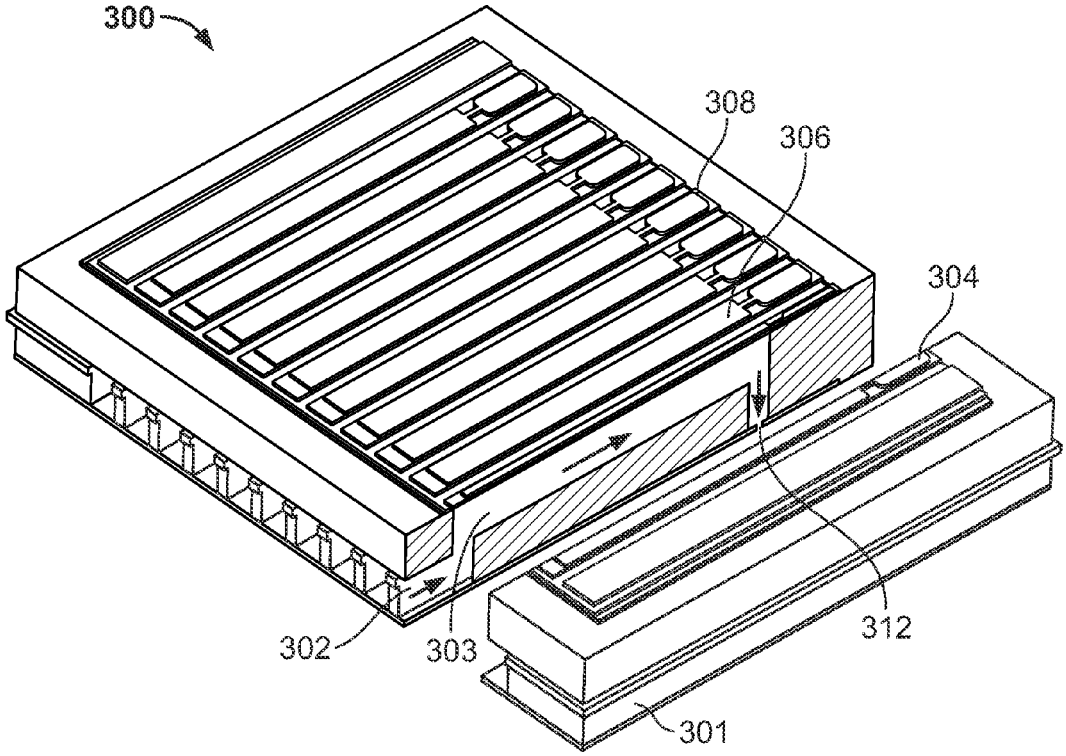
Figure 3B:
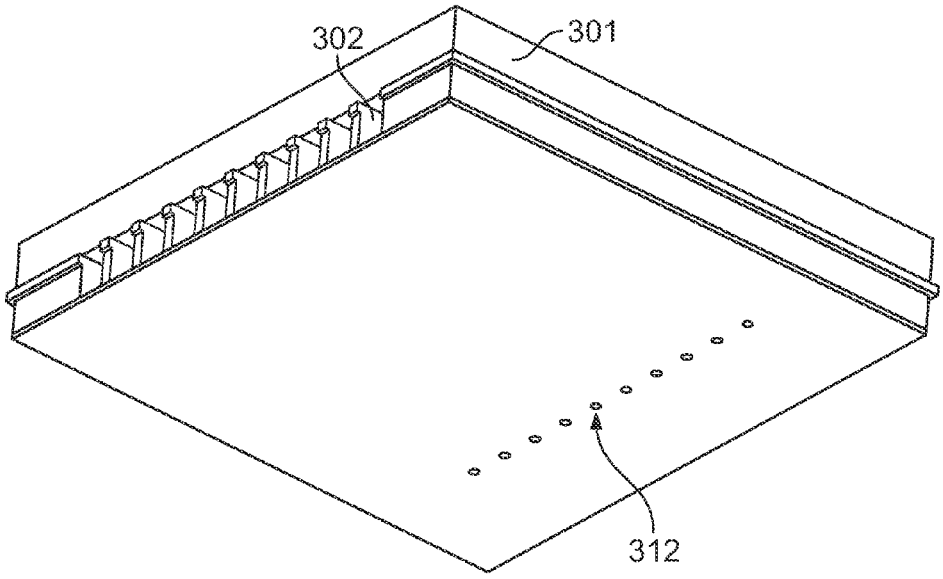

The printhead modules 100 and 200 described above can be used with any suitable printhead body. One embodiment of a printhead body 300 that includes 10 nozzles is shown in FIGS. 3A and 3B. The printhead body 300 is formed from a substrate 301, e.g., a silicon wafer. The nozzles 312 are formed on the nozzle face (FIG. 3B) and piezoelectric transducers are formed on the back face (FIG. 3A). Ink inlets 302 lead to pumping chambers (not shown) corresponding to each nozzle 312. A drive contact 304 is operable to receive a signal for each nozzle 312. The signal causes a voltage through a drive electrode 306 creating a voltage differential across a piezoelectric material 308 beneath the drive electrode 306. The piezoelectric material 308 deflects thereby pressurizing a pumping chamber directly beneath the piezoelectric material 308 and causing an ink droplet to eject from a corresponding nozzle 312. A flexible circuit can be connected to the drive electrodes 306 to selectively control activation of the nozzles 312. In one implementation, the flexible circuit can be connected, directly or indirectly (e.g, via an external flexible circuit) to a processor or integrated circuit from which drive signals to control the nozzles 312 originate.

Referring again to FIG. 1E, the printhead body 106 shown within the printhead housing 104 includes ink inlets formed along a side of the printhead body 106, similar to the printhead body 300 depicted in FIGS. 3A-B. FIG. 1E illustrates one implementation of an ink path from the printhead housing 102 to a printhead body having side ink inlets as in the printhead body 300.

The exemplary printhead body 300 shown includes 10 nozzles, however, more or fewer nozzles can be included. In one embodiment, the printhead body 300 includes a single nozzle. The printhead body 300 can be fabricated using techniques described in U.S. patent application Ser. No. 10/962,378, entitled "Print Head With Thin Membrane", filed Oct. 8, 2004, and/or techniques described in U.S. Provisional Patent Application No. 60/621,507 entitled "Sacrificial Substrate for Etching", filed Oct. 21, 2004, the entire contents of which applications are hereby incorporated by reference herein.

Figure 4A:
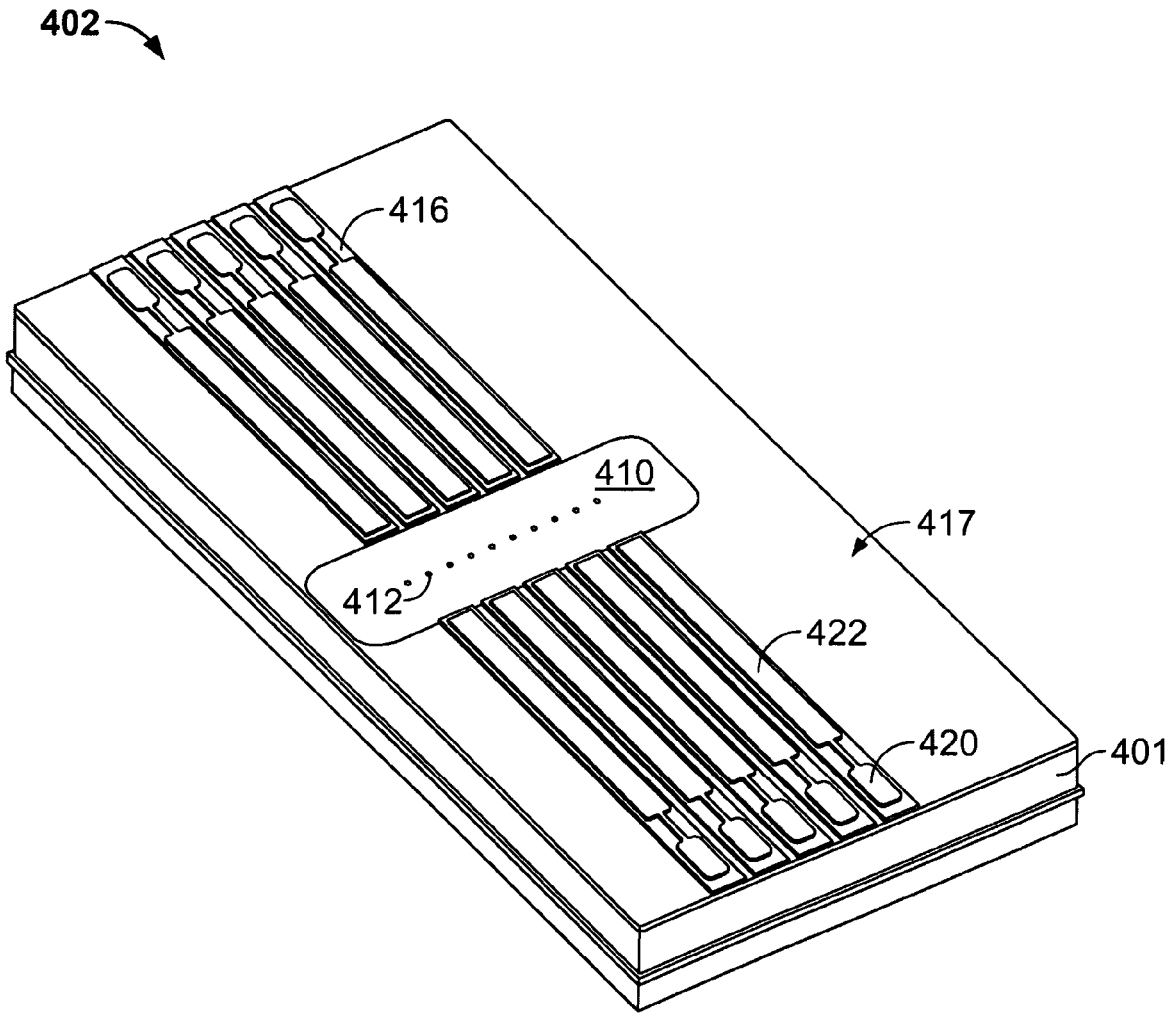
Figure 4B:
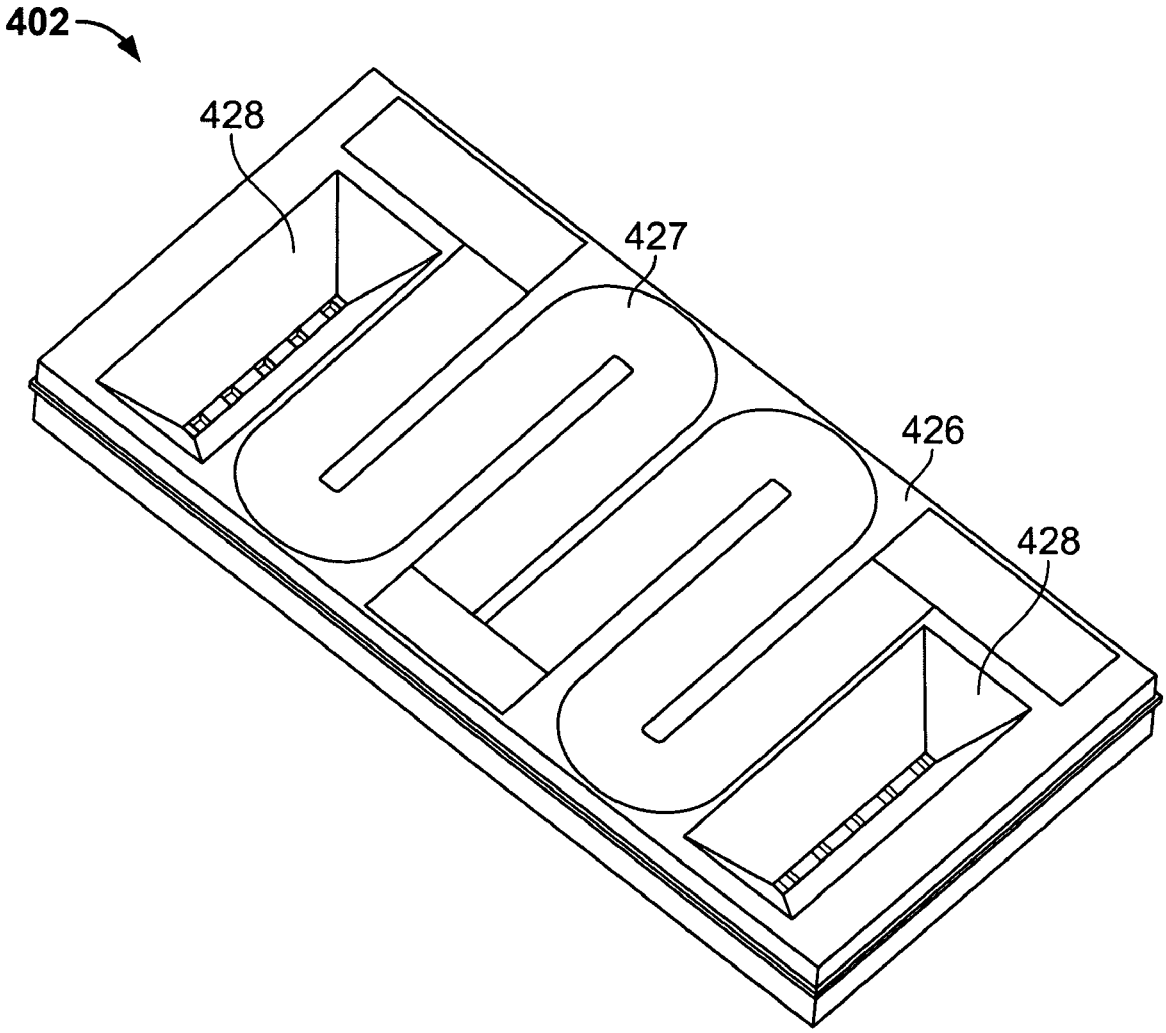

Another embodiment of a printhead body 400 is shown in FIGS. 4A and 4B. In this embodiment, the drive contacts 420 and drive electrodes 422 are formed on the nozzle face. The 10-nozzle printhead body 402 is formed from a base substrate 401, a nozzle plate 410 and a piezoelectric layer 416. Ten nozzles 412 are formed in the nozzle plate 410. A ground electrode layer 417 is formed on the upper surface of the nozzle plate 410 and drive contacts 420 and drive electrodes 422 are formed on the sectioned piezoelectric layer 416. The back face 426 of the printhead body 402 is depicted in FIG. 4B, and includes two ink channels 428. The ink channels 428 are in fluid communication with ten pumping chambers formed within the base substrate 401 beneath the sections of piezoelectric material; each pumping chamber feeds ink to a corresponding nozzle 412. The embodiment shown includes a serpentine-like heater 427 formed on the back face 426 of the printhead body 402, which can be used to warm the ink to a desired operating temperature.

The exemplary printhead body 402 shown includes 10 nozzles, however, the printhead body 402 can be formed with more or fewer nozzles. In one embodiment the printhead body 402 includes a single nozzle.

The printhead module further includes a contact face for electrically connecting to a source providing signals to selectively activate the nozzles and can be configured to mount within a printing device to eject the printing liquid contained therein onto a substrate. The configuration of the contact face can differ depending on the configuration of the printhead body.

Figure 5A:
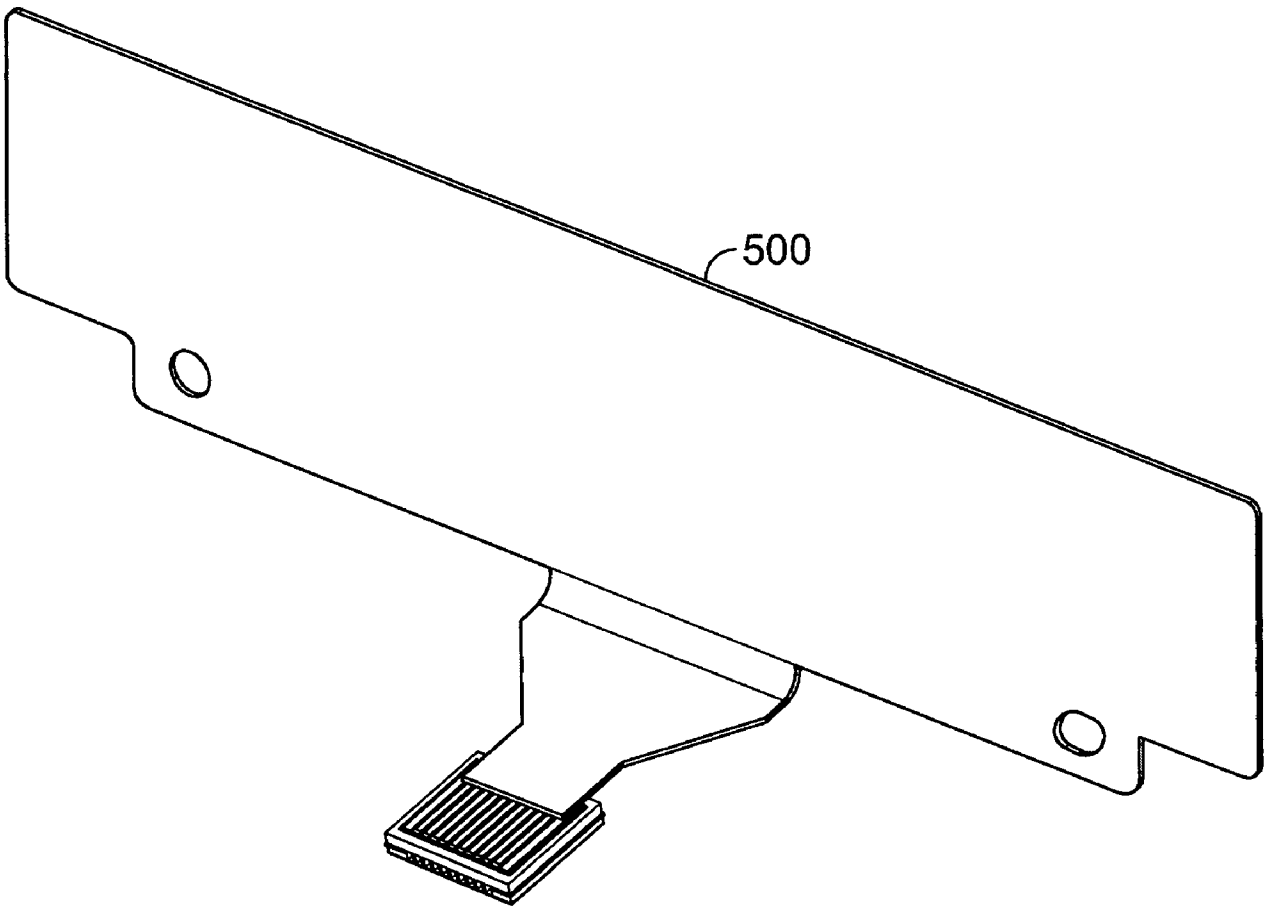
Figure 5B:
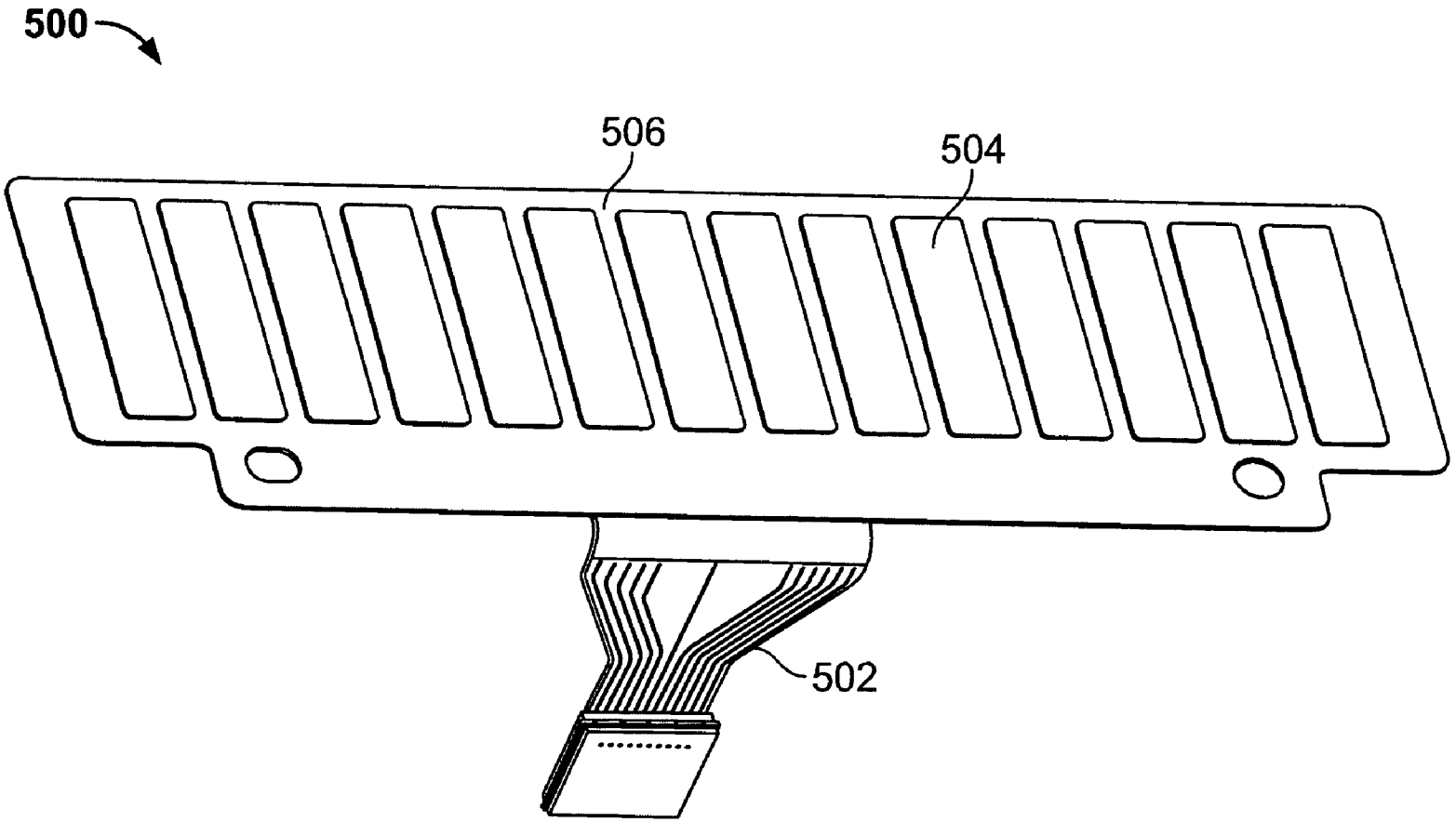
Figure 5C:
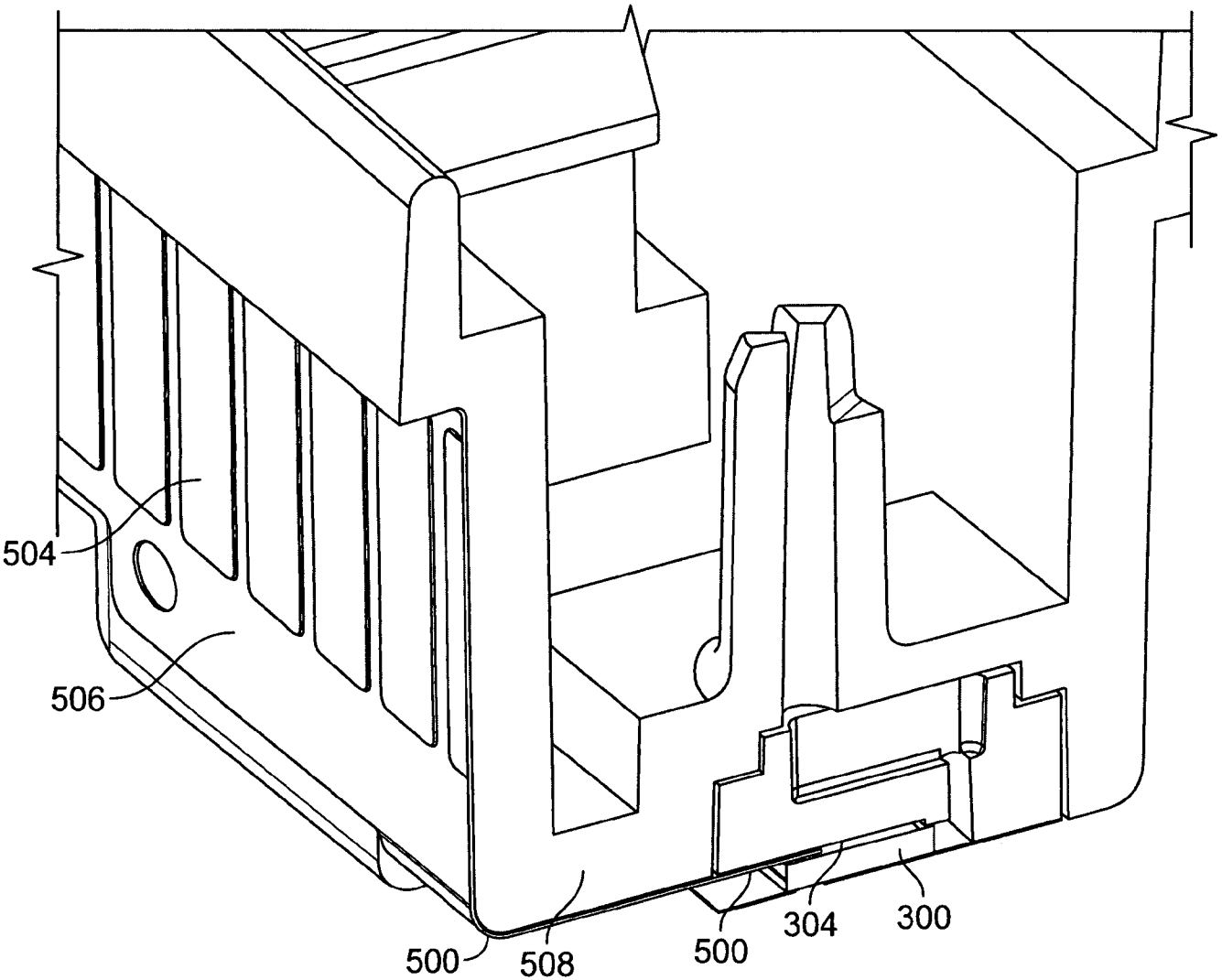

For example, FIGS. 3A and 3B illustrate a printhead body 300 having drive contacts 304 on the back face (i.e., the opposite face from the nozzle face). Referring to FIGS. 5A-C, the printhead body 300 can be connected to a flexible circuit 500 that includes leads 502 that electrically connect to the drive contacts 304 on the back face of the printhead body 300. Each lead 502 provides signals to a drive contact 304 to selectively activate the corresponding nozzle 312. The leads 502 are electrically connected to contacts 504 formed on a contact face 506 of the flexible circuit 500.

Figure 6A:
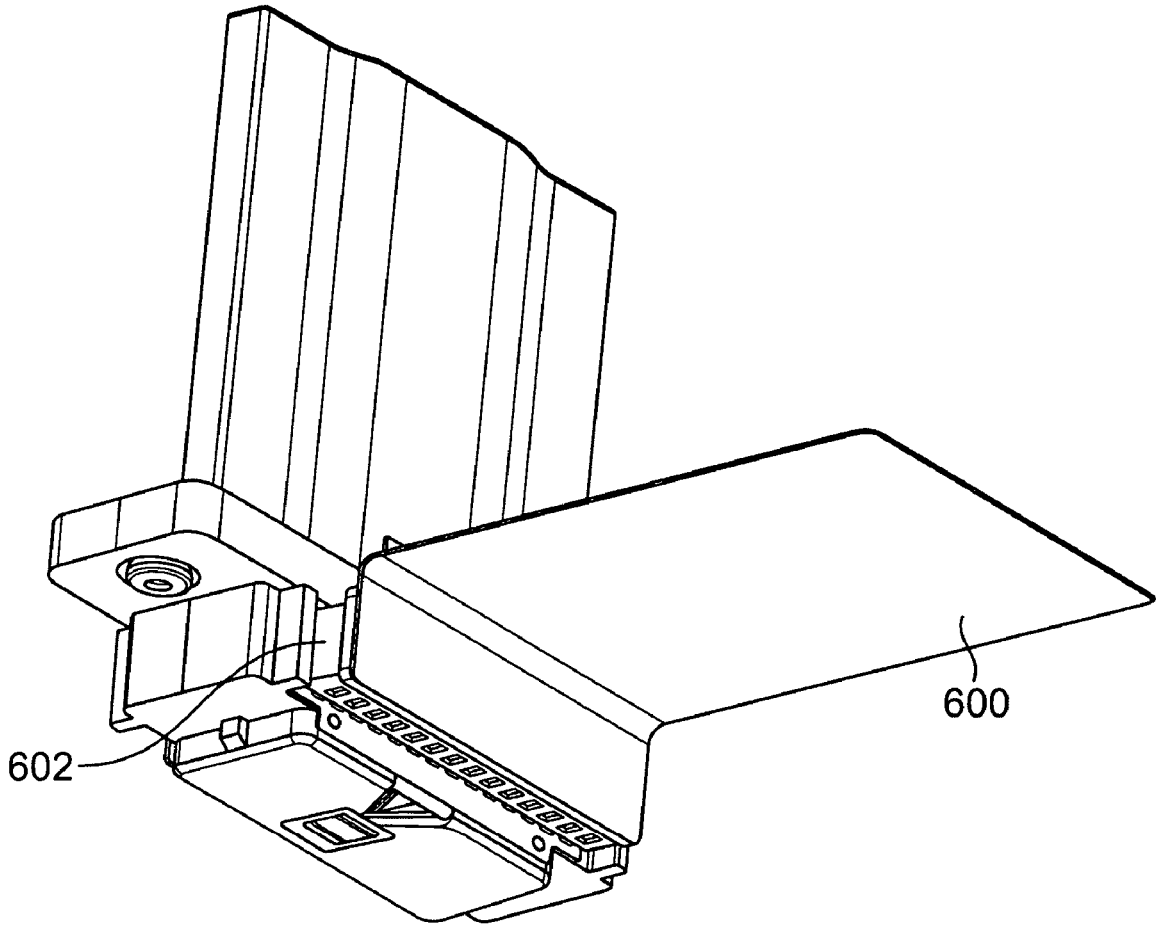
FIG. 6A shows a droplet ejection module attached to an external flexible circuit.
Figure 6B:
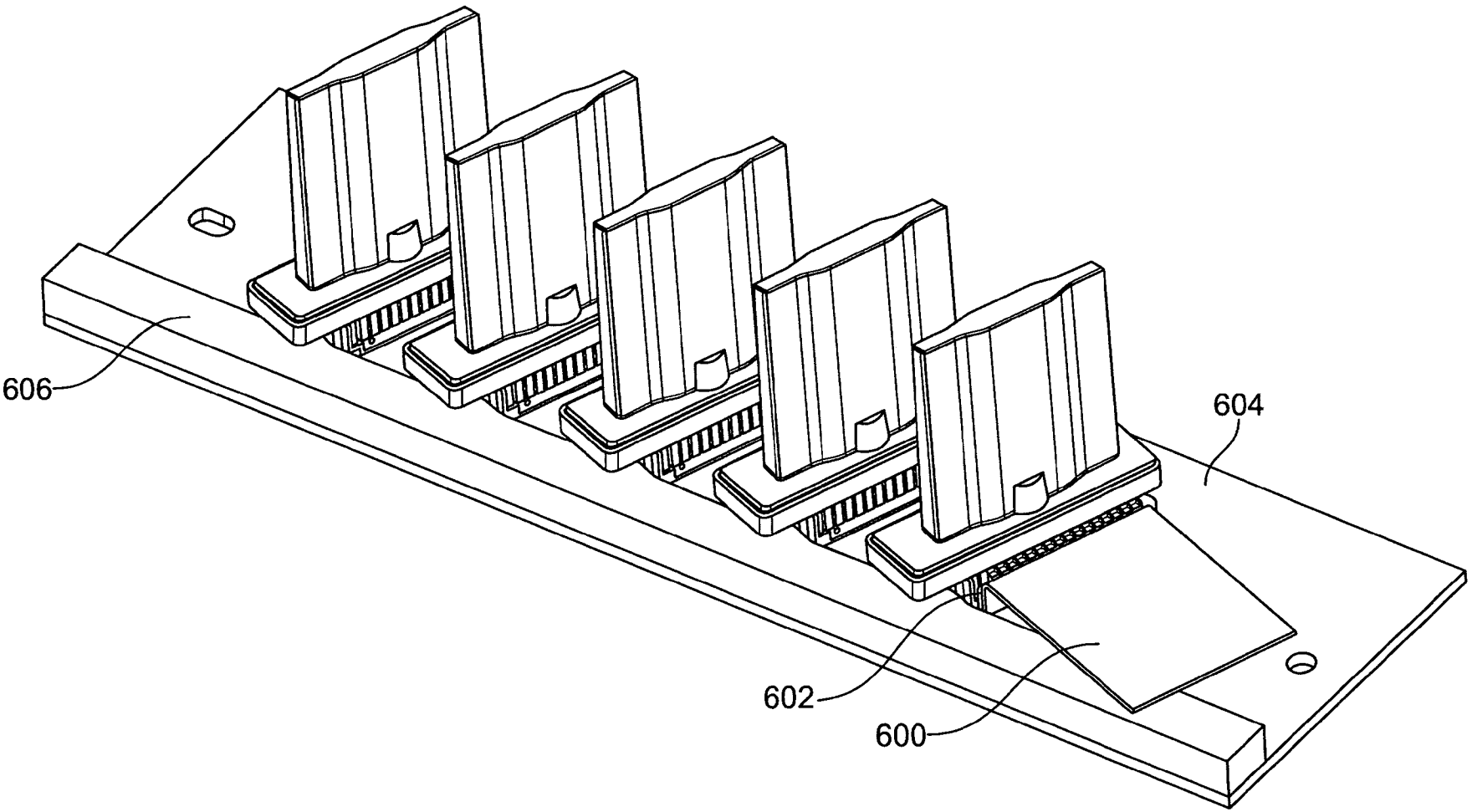
FIG. 6B shows multiple droplet ejection modules attached to a mounting structure.

The flexible circuit 500 is configured to wrap around a side of a printhead housing 508 as shown in FIG. 5C. The contacts 504 can be electrically connected to an external circuit that provides the signals to selectively activate the nozzles 312. For example, referring to FIG. 6A, an external flexible circuit 600 having a connector 602 can connect to the contact face 506 of the flexible circuit 500. FIG. 6B shows an exemplary mounting structure 604 that is configured to receive up to five printhead modules. Each printhead module includes a contact face 506 having contacts 504 that can connect to an external flexible circuit 600. For illustrative purposes, only the end printhead module is shown connected to an external flexible circuit 600, however, it should be understood that more or all of the printhead modules can be simultaneously connected to external flexible circuits. The exemplary mounting structure 604 includes a meniscus vacuum bar 606 that attaches to vacuum ports included in the printhead modules to provide a vacuum pressure to the ink bags, as described above.

In another implementation, the printhead module can be configured to mount with a cartridge mount assembly as described in Appendix A entitled "Fluid Deposition Device", which is hereby incorporated into this Specification.

In one embodiment, the printhead module and a mounting structure can be configured so that in a single connection step, an electrical connection is made to the printhead module and a connection is made from a vacuum source to the vacuum port. For example, if the printhead module is positioned into the mounting structure, then with one positioning step, the contacts on the contact face of the printhead module can electrically connect, e.g., to an external flexible circuit and/or to an external device (e.g., to send signals to actuate the nozzles), and the vacuum port can connect to a vacuum source, e.g., the meniscus vacuum bar 606. The external flexible circuit can be connected to a processor or integrated circuit from which drive signals to the nozzles originate.

Another embodiment of a contact face for a printhead module can be described in reference to FIGS. 1A and 4A-B that can be used when the printhead body is configured with drive contacts on the same face as the nozzles. Referring particularly to FIG. 4A, the printhead body 402 includes drive contacts 420 that are on the same face of the printhead body 402 as the nozzles 412. Referring to FIG. 1A, a flexible circuit 160 including a contact face 162 can be attached to a side of the printhead housing 104 and wrap around to the underside of the printhead housing 104 to make contact with the drive contacts 420 formed on the nozzle face of the printhead body 402. The flexible circuit 160 includes a cutout or opening to expose the nozzles 412.

The flexible circuit 160 can be formed similar to the flexible circuit 500 described above, in that the flexible circuit 160 can include leads that connect to the drive contacts 420 to provide signals to selectively activate the corresponding nozzles 412. The flexible circuit 160 includes a contact face 164 having contacts 166 to electrically connect to an external circuit providing the drive signals for the nozzles. For example, referring again to FIG. 6A, the external flexible circuit 600 having a connector 602 can connect to the contact face 162 of the flexible circuit 160. The printhead module 100 can be mounted in the mounting structure 604 shown in FIG. 6B and connect to the external flexible circuit 600.

Referring to FIGS. 7A-E, an alternative embodiment of the printhead module 700 is shown. This embodiment is substantially similar to the printhead module 100 shown in FIG. 1. In the printhead module 700 shown in FIGS. 7A-E, the ink inlet 724 and ink channel 126 are included within an ink column 702 that is formed separately from the printhead housing 704. An aperture 706 is formed within the lower portion of the printhead housing 704 configured to receive the ink column 702.

The ink path from the self-contained ink reservoir (ink bag) 708 to the printhead body 706 is similar to the ink path described in reference to the printhead module 100 depicted in FIGS. 1A-H. That is, the ink column 702 includes fingers 732 and grooves 734. The ink supply assembly 703 includes an outlet head 718 also having fingers 736 radiating from a central hub 739 and separated by flow paths 738. The flow paths 738 provide an ink path from the ink bag 708. In a closed position, a seal 710 is in contact with the bottom surface of the outlet head 718 and blocks the flow paths 738; ink cannot flow past the fingers 736. A spring 714 in the outlet head 718 exerts a downward force compressing the seal 710.

In an open position, the bottom of the outlet head 718 contacts the ink inlet 724, which can compress the spring 714 within the outlet head 718. The seal 710 is positioned past the distal end of the ink inlet 724 and is not in contact with the bottom of the outlet head 718; the flow paths 738 are no longer blocked by the seal 710. Ink can thereby flow from the ink bag 708 through the flow paths 738 formed between the fingers 736 of the outlet head 718 and into the ink channel 726 formed in the ink inlet 724 through the grooves 734 formed therein.

Figure 7A:
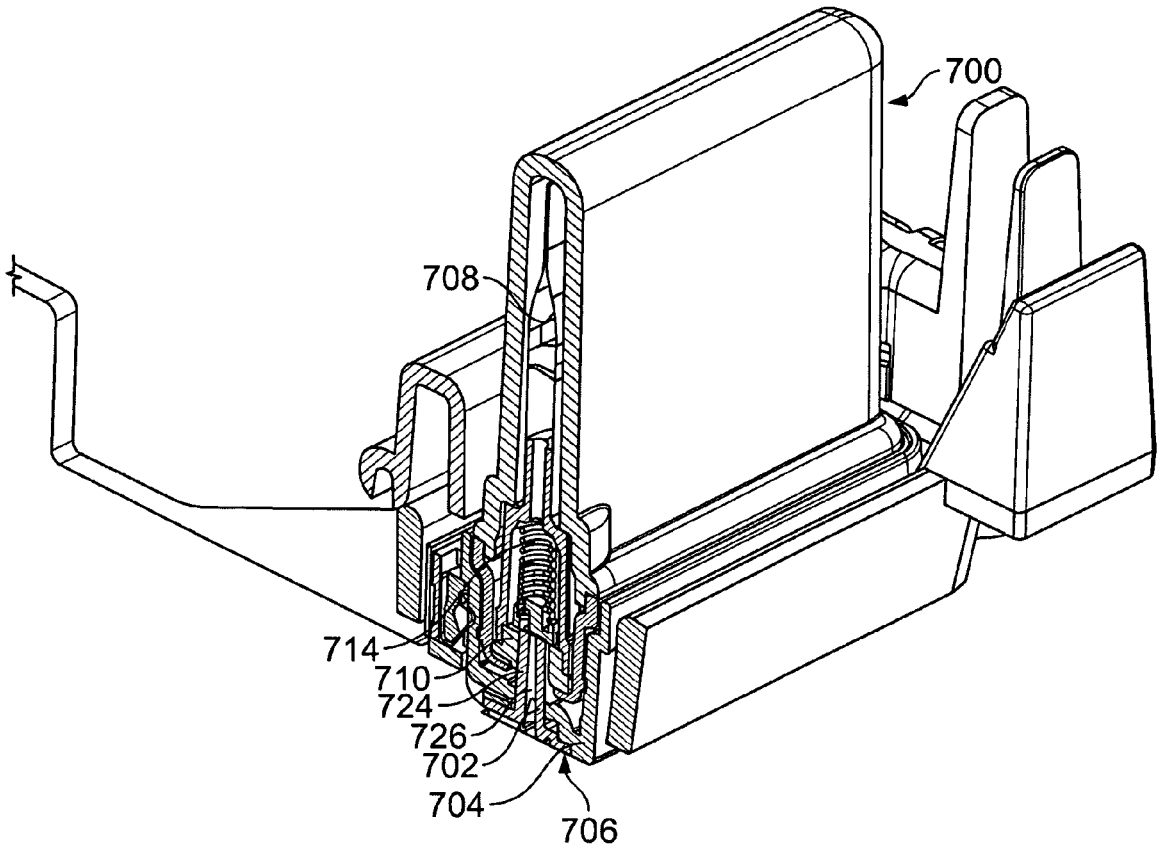
Figure 7B:
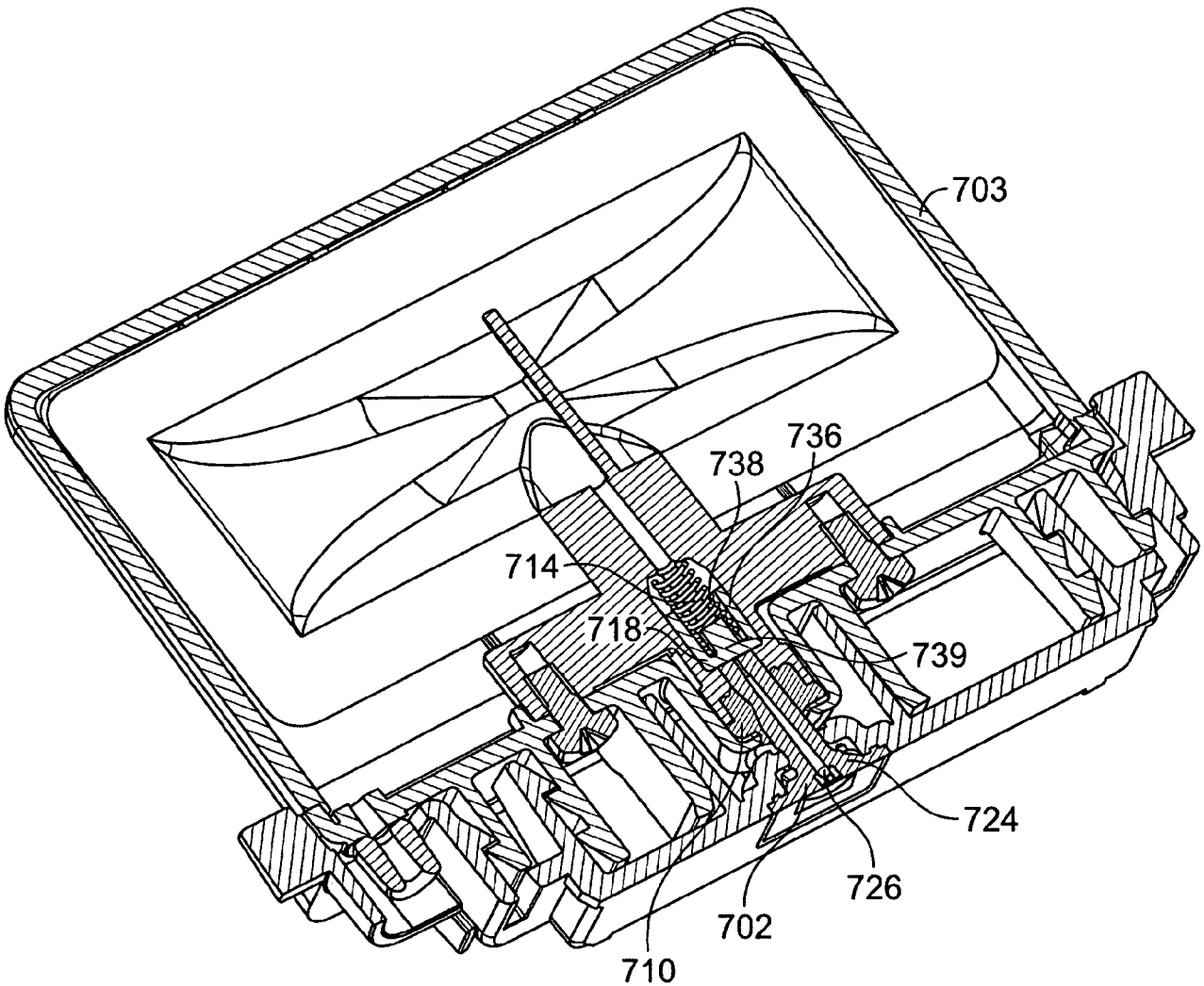
Figure 7C:
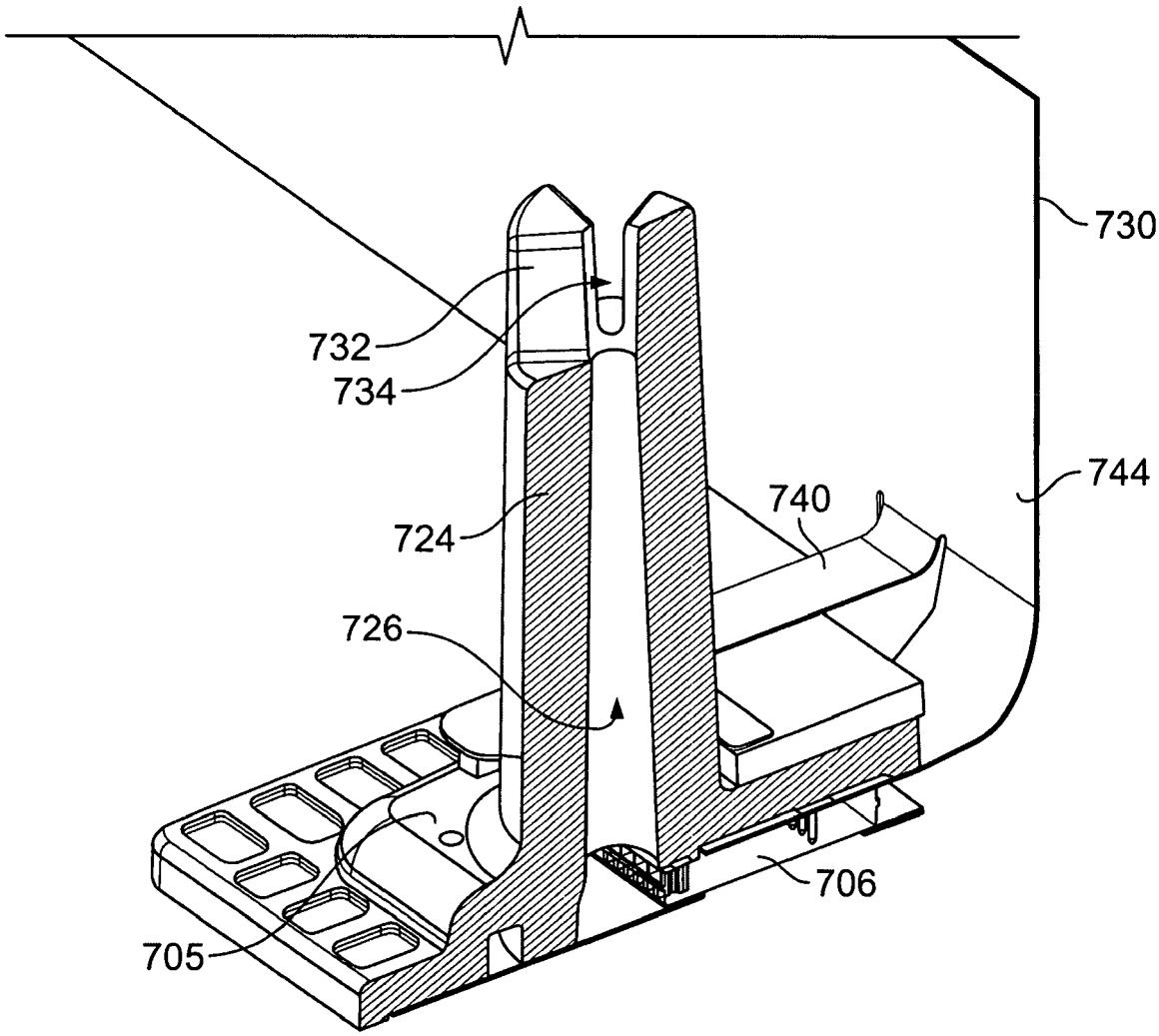
Figure 7D:
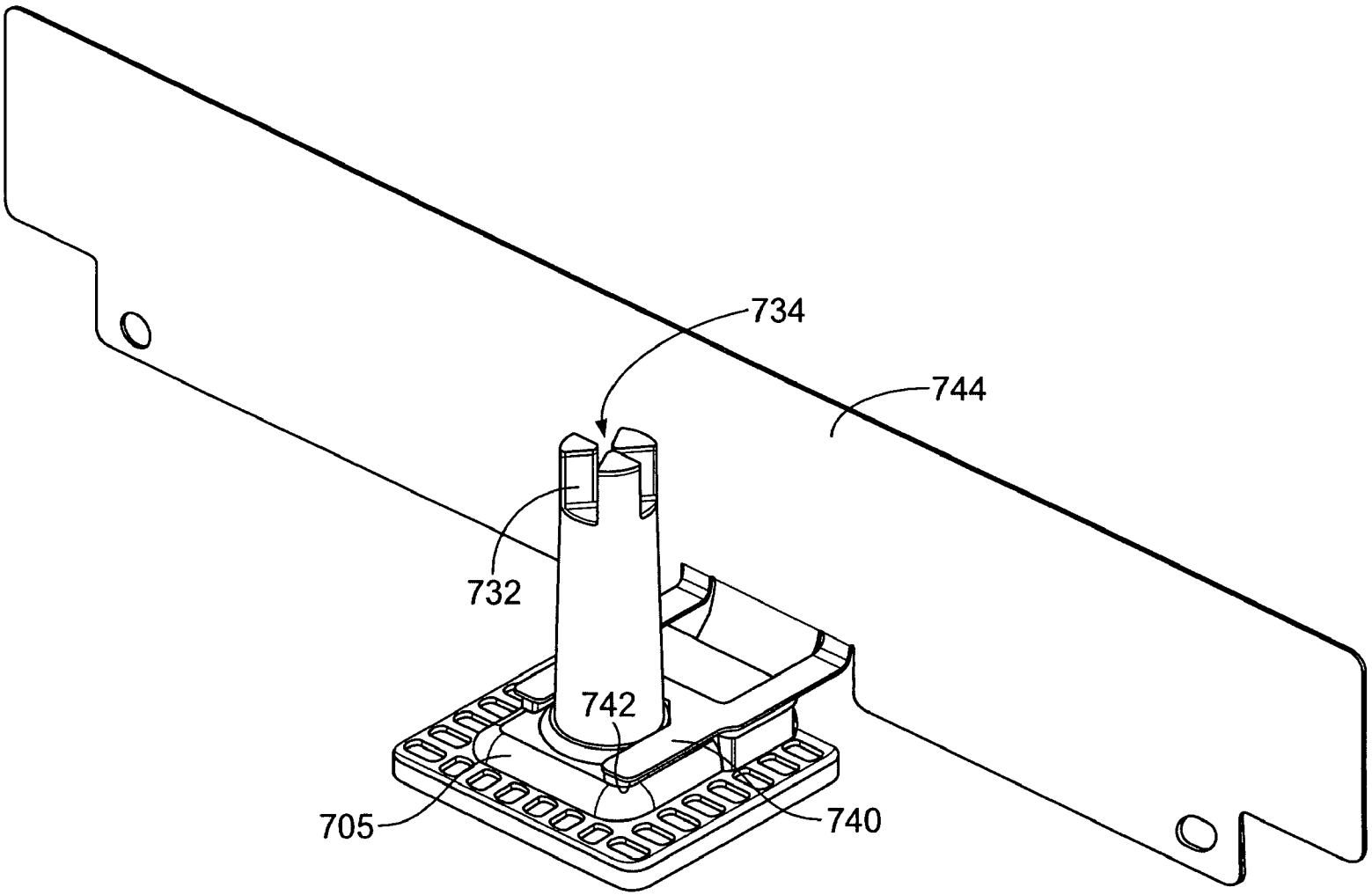
Figure 7E:
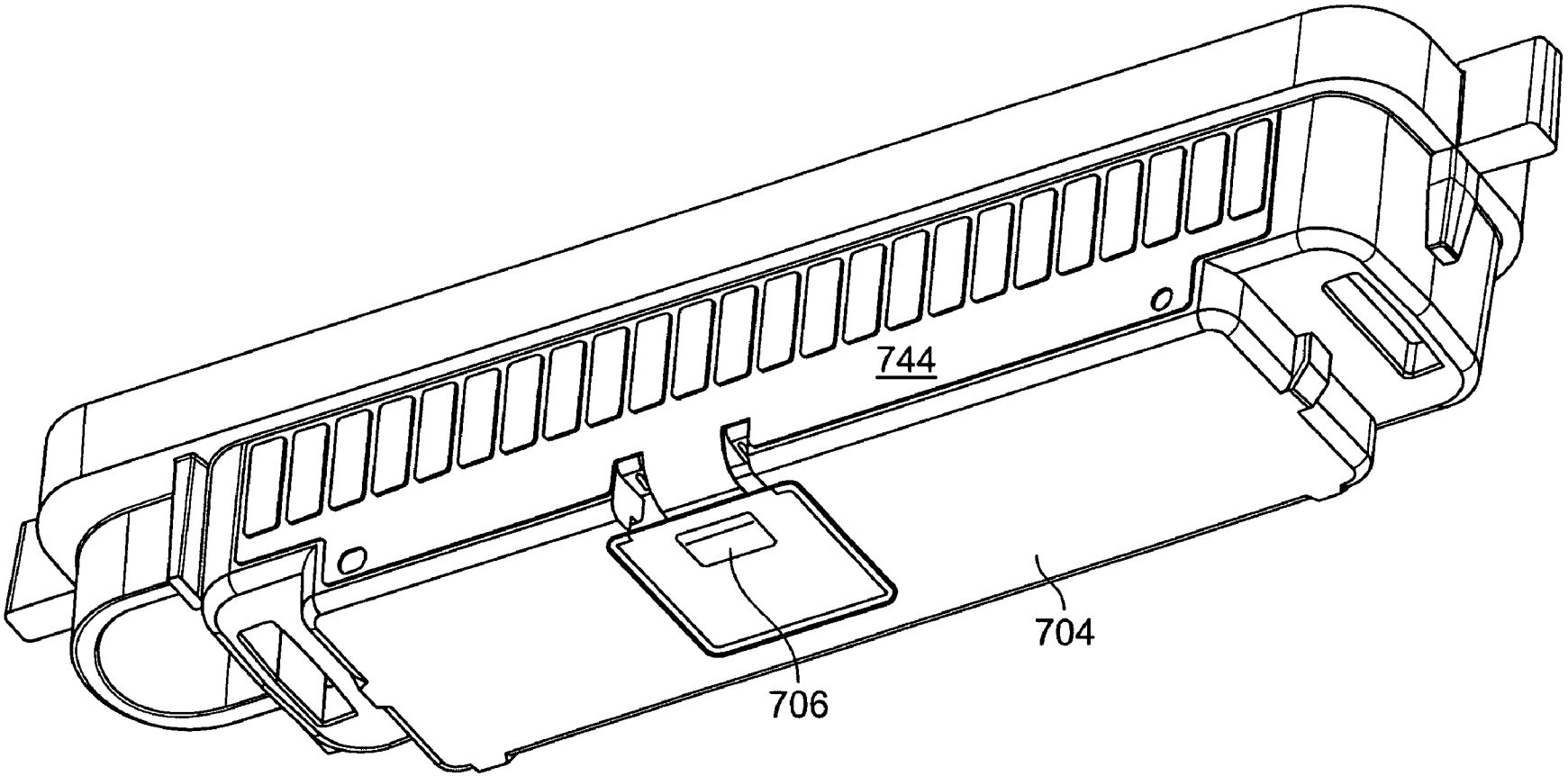

Referring particularly to FIGS. 7C and 7D, the ink column 702 can be connected to the printhead body 706 and a flexible circuit 730. Ink can flow through the ink channel 126 and into the printhead body 706 through apertures formed corresponding to pumping chambers within the printhead body 706 as shown. In the implementation shown, a portion of the flexible circuit 730 is positioned between the ink column base 705 and the upper surface of the printhead body 706. The flexible circuit 730 provides drive signals to actuators included in the printhead body 706 to fire the nozzles. A second portion 740 of the flexible circuit is positioned on top of the ink column base 705. In one implementation, a heat element 742 and thermistor (not shown) can be included on the underside of the second portion 740 of the flexible circuit in contact with the ink column base 705. Optionally, an electrostatic discharge can also be included on the second portion 740 of the flexible circuit. The main portion 744 of the flexible circuit 730 attaches to an exterior face of the printhead housing 704 as shown in FIG. 7E. The flexible circuit 730 can connect to an external flexible circuit that is connected directly or indirectly to a processor or integrated circuit providing drive signals to the nozzles included in the printhead body 706, in a similar manner as described above in reference to other embodiments.

The printhead module 700 can also be mounted into a mounting assembly as shown in FIG. 6B, or a cartridge mount assembly as described in Appendix A, or other configurations of mounting apparatus. Similarly, the printhead module 700 can be connected into a mounting assembly to make both the electrical connections and a vacuum connection in a single step, as described above in reference to other embodiments.

As previously mentioned, ink is just one example of a printing liquid. It should be understood that references to ink as the printing liquid were for illustrative purposes only, and referring to components within the printhead module described above with the adjective "ink" was also illustrative. That is, referring to a channel or a supply assembly as an "ink inlet" or an "ink supply assembly" was for illustrative purposes, and a more general reference, such as to a "printing liquid inlet" or a "printing liquid supply assembly" can be used. Further, as previously mentioned, the drop ejection module has been referred to for illustrative purposes as a printhead module, however, the use can be broader than printing operations per se, and can be used to eject drops of any sort of liquid for various purposes.

The use of terminology such as "front" and "back" and "top" and "bottom" throughout the specification and claims is for illustrative purposes only, to distinguish between various components of the printhead module and other elements described herein. The use of "front" and "back" and "top" and "bottom" does not imply a particular orientation of the printhead module.

Although only a few embodiments have been described in detail above, other modifications are possible. Other embodiments may be within the scope of the following claims.

What is claimed is:

1. A droplet ejection module, comprising:

a liquid supply assembly including a self-contained liquid reservoir and a liquid outlet;

a housing configured to connect to the liquid supply assembly and including a liquid channel configured to receive a liquid from the liquid outlet of the liquid supply assembly and to deliver the liquid to a droplet ejection body; and a droplet ejection body mounted within the housing and including one or more liquid inlets configured to receive the liquid from only the liquid supply assembly directly via the housing and fluidly coupled to one or more nozzles, the droplet ejection body including one or more actuators configured to selectively eject droplets from the one or more nozzles and one or more electrical contacts to receive one or more electrical signals to drive the one or more actuators wherein:

the housing is connectable to the liquid supply assembly in a closed first position where the liquid is prevented from exiting the liquid outlet and entering the liquid channel;

the housing is connectable to the liquid supply assembly in an open second position where the liquid is not prevented from exiting the liquid outlet and entering the liquid channel; and once the housing is connected to the liquid supply assembly in the closed first position, the housing can only be moved into the open second position and cannot be separated from the liquid supply assembly.

2. The droplet ejection module of claim 1, wherein the liquid supply assembly further comprises:

a seal operable to prevent the liquid from exiting the liquid reservoir through the liquid outlet.

3. The droplet ejection module of claim 2, wherein:

in the closed first position, the seal prevents the liquid from exiting the liquid outlet and entering the liquid channel; and in the open second position, the seal does not prevent the liquid from exiting the liquid outlet and entering the liquid channel.

4. The droplet ejection module of claim 1, wherein:

the housing is configured to connect to the liquid supply assembly in the first and the second positions by a double snap-fit connection.

5. The droplet ejection module of claim 4, wherein the housing further comprises an elongated, pointed member configured to puncture the seal when the housing is connected to the liquid supply assembly in the second position.

6. The droplet ejection module of claim 4, wherein the liquid supply assembly further comprises a spring activated mechanism configured to maintain the seal while the housing is connected to the liquid supply assembly in the first position and release the seal when the housing is connected to the liquid supply assembly in the second position.

7. The droplet ejection module of claim 1, wherein the liquid supply assembly further comprises:

a liquid supply housing; and an evacuable chamber formed within the liquid supply housing and coupled to a port for withdrawing fluid from the chamber.

8. The droplet ejection module of claim 7, wherein the liquid reservoir comprises a flexible container adapted to contain the liquid and is positioned within the evacuable chamber in the liquid supply housing.

9. The droplet ejection module of claim 7, further comprising:

a flexible circuit electrically connected to the one or more electrical contacts included in the droplet ejection body to provide drive signals controlling droplet ejection from the one or more nozzles, the flexible circuit including a contact face configured to electrically connect to an external circuit providing the drive signals.

10. The droplet ejection module of claim 9, where the port coupled to the evacuable chamber and the contact face of the flexible circuit are configured such that in a single connection to a mounting assembly, the port fluidly connects to an evacuation source and the contact face electrically connects to an external circuit.

11. The droplet ejection module of claim 1, wherein the liquid reservoir comprises a flexible container adapted to contain a liquid.

12. The droplet ejection module of claim 1, wherein the liquid supply assembly further comprises a port fluidly connected to the liquid reservoir and configured to receive the liquid.

13. The droplet ejection module of claim 12, wherein the port is self-sealing.

14. The droplet ejection module of claim 1, wherein the housing and the liquid supply assembly are permanently connected and inseparable once a fluid connection is made between them.

15. A droplet ejection module, comprising:

a liquid supply assembly including a self-contained liquid reservoir and a liquid outlet providing a liquid path for a liquid from the liquid supply assembly to a liquid channel formed in a droplet ejection body;

a housing configured to:

connect to the liquid supply assembly in a closed first position where the liquid is prevented from exiting the liquid outlet and entering the liquid channel; and connect to the liquid supply assembly in an open second position where the liquid is not prevented from exiting the liquid outlet and entering the liquid channel;

where once the housing is connected to the liquid supply assembly in the closed first position, the housing can only be moved into the open second position and cannot be separated from the liquid supply assembly;

a droplet ejection body permanently mounted within the housing and including a nozzle face having at least one nozzle, the droplet ejection body including one or more liquid inlets configured to receive the liquid only from the liquid supply assembly directly via the housing and fluidly coupled to the at least one nozzle, at least one actuator configured to selectively eject droplets from the at least one nozzle and at least one electrical contact to receive one or more electrical signals to drive the at least one actuator and further including at least one liquid channel; and a flexible circuit attached to the housing and to the nozzle face of the droplet ejection body, where the flexible circuit is electrically connected to the droplet ejection body to provide the one or more electrical signals to the at least one actuator to control liquid ejection from the at least one nozzle.

16. The droplet ejection module of claim 15, the droplet ejection body further comprising:

one or more pumping chambers formed in a base substrate, where each pumping chamber includes a receiving end configured to receive a liquid from a liquid supply and an ejected end for ejecting liquid from the pumping chamber.

17. The droplet ejection module of claim 16, the droplet ejection body further comprising:

a nozzle plate attached to the base substrate including one or more nozzles formed through the nozzle plate, where each nozzle is in fluid communication with a pumping chamber and receives liquid from the ejected end of the pumping chamber for ejection from the nozzle.

18. The droplet ejection module of claim 17, wherein the at least one actuator included in the droplet ejection body comprises:

one or more piezoelectric actuators connected to the nozzle plate, where a piezoelectric actuator is positioned over each pumping chamber and includes a piezoelectric material configured to deflect and pressurize the pumping chamber so as to eject liquid from a corresponding nozzle that is in fluid communication with the ejecting end of the pumping chamber.

19. The droplet ejection module of claim 15, the liquid supply assembly further comprising:

a liquid supply housing; and an evacuable chamber formed within the liquid supply housing fluidly coupled to a port for withdrawing a fluid from the chamber; and a bag adapted to contain a liquid, the bag positioned within the evacuable chamber.

20. The droplet ejection module of claim 19, wherein:

the flexible circuit further comprises a contact face configured to electrically connect to an external circuit providing the one or more electrical signals; and the port coupled to the chamber and the contact face of the flexible circuit are configured such that in a single connection to a mounting assembly, the port fluidly connects to an evacuation source and the contact face electrically connects to an external circuit.

21. The droplet ejection module of claim 15, wherein the housing is configured to permanently connect to the liquid supply assembly, and they are inseparable once a fluid connection is made between them.

22. The droplet ejection module of claim 15, wherein the liquid channel is formed in a back face of the droplet ejection body.

* * * * *

UNITED STATES PATENT AND TRADEMARK OFFICE

CERTIFICATE OF CORRECTION

PATENT NO. : 7,631,962 B2
APPLICATION NO. : 11/305824
DATED : December 15, 2009
INVENTOR(S) : Bibl et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 571 days.

Signed and Sealed this

Twenty-first Day of December, 2010

David J. Kappos

David J. Kappos
*Director of the United States Patent and Trademark Office*